US005581273A

United States Patent [19]

Yoneda et al.

[11] Patent Number: 5,581,273

[45] Date of Patent: Dec. 3, 1996

[54] IMAGE DISPLAY APPARATUS

[75] Inventors: Hiroshi Yoneda, Ikoma; Kenichi Katoh, Tenri; Yutaka Ishii, Nara; Yasushi Kubota, Sakurai, all of Japan

[73] Assignee: Sharp Kabushiki Kaisha, Japan

[21] Appl. No.: 263,742

[22] Filed: Jun. 22, 1994

[30] Foreign Application Priority Data

Jun. 28, 1993 [JP] Japan ..... 5-157353
Dec. 28, 1993 [JP] Japan ..... 5-349921

[51] Int. Cl.[6] ..... G09G 3/36

[52] U.S. Cl. ..... 345/90; 345/98

[58] Field of Search ..... 345/90–93, 98–100

[56] References Cited

U.S. PATENT DOCUMENTS

| | | | |
|---|---|---|---|
| 4,532,506 | 7/1985 | Kitazima et al. | 345/90 |
| 4,621,260 | 11/1986 | Suzuki et al. | 345/92 |
| 4,870,396 | 9/1989 | Shields | 345/92 X |
| 5,349,366 | 9/1994 | Yamazaki et al. | 345/92 |

OTHER PUBLICATIONS

Sakal et al., "A Defect–Tolerant Technology for an Active–Matrix LCD Integrated with Peripheral Circuits", SID 88 Digest, vol. XIX, Disneyland Hotel, Anaheim, California, May 24–26, 1988, pp. 400–403.

*Primary Examiner*—Ulysses Weldon
*Attorney, Agent, or Firm*—Nixon & Vanderhye

[57] ABSTRACT

An active matrix type image display apparatus which includes: a plurality of data signal lines; a plurality of scanning signal lines crossing the plurality of data signal lines; and a plurality of pixel portions disposed in a matrix in areas enclosed by the plurality of data signal lines and the plurality of scanning signal lines, wherein each of the plurality of pixel portions includes: a pixel capacitor for storing electric charge supplied from at least one of the plurality of data signal lines, to display an image; storage unit connected to the pixel capacitor; and switching unit which alternately selects one of an operation for electrically connecting the pixel capacitor to the storage unit and an operation for electrically disconnecting the pixel capacitor from the storage unit.

8 Claims, 21 Drawing Sheets

Fig. 4A(1)
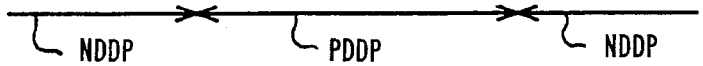
Fig. 4A(2) Potential a
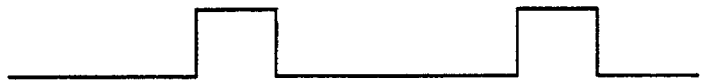
Fig. 4A(3) Potential b
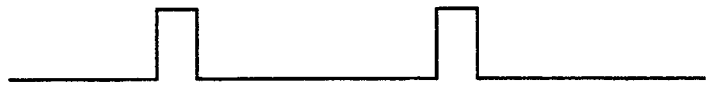
Fig. 4A(4) Potential c
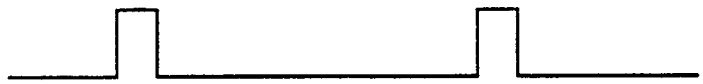
Fig. 4A(5) Potential of Cp1
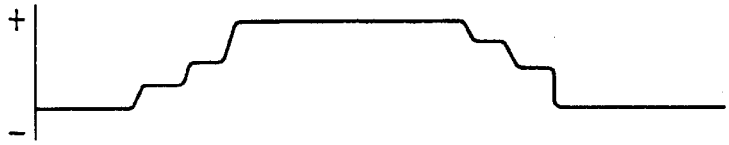
Fig. 4B(1)
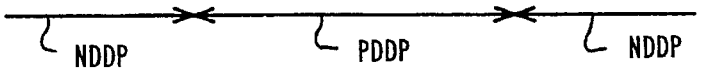
Fig. 4B(2) Potential a
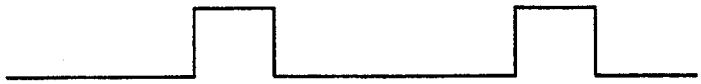
Fig. 4B(3) Potential b
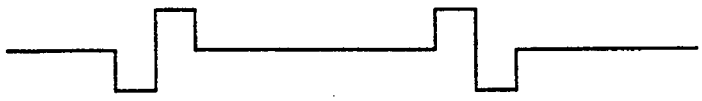

NDDP
PDDP
NDDP

Potential a

Potential b

Potential c
+

Potential of Cp1
−

Fig. 8A(1)
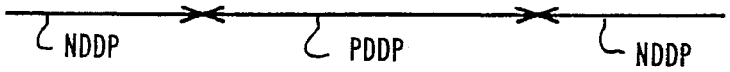
Fig. 8A(2) Potential a
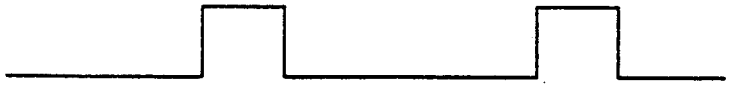
Fig. 8A(3) Potential b
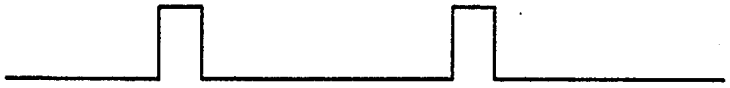
Fig. 8A(4) Potential c
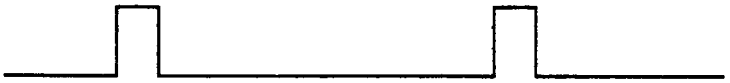
Fig. 8B(1)
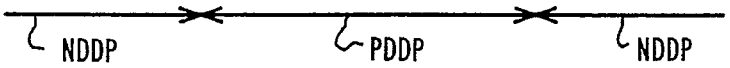
Fig. 8B(2) Potential a
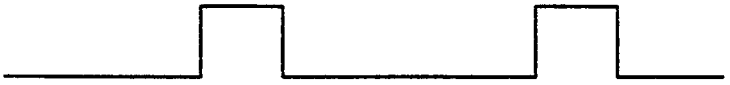
Fig. 8B(3) Potential b
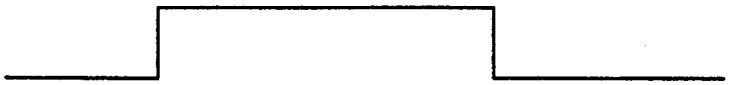
Fig. 8B(4) Potential c
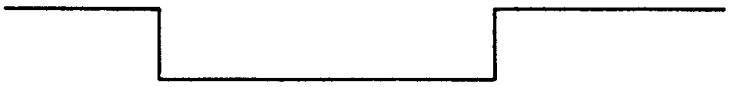

SCP
SCP
Display period
Display period

Potential Cp2

Potential Cp4

Switch control signal
(SW5)

LWP0
LWP1
LWP2

IMAGE DISPLAY APPARATUS

BACKGROUND OF THE INVENTION

1. Field of the Invention

The present invention relates to an image display apparatus such as an active matrix driving liquid crystal display apparatus.

2. Description of the Related Art

As an image display apparatus, a display apparatus employing an active matrix driving mechanism has been known. This image display apparatus includes a plurality of scanning signal lines and a plurality of data signal lines. Each of the scanning signal lines intersects respective data signal lines. Pixels are provided in the portions surrounded by two adjacent scanning signal lines and two adjacent data signal lines, and are arranged into a matrix pattern.

In the case of a liquid crystal display for instance, as shown in FIG. 23, each pixel Z comprises a transistor TR such as a TFT (Thin Film Transistor) or an FET as a driving element, a pixel capacitor $C_p$, and an storage capacitor Cs which is added as necessary. As shown in this figure, a data signal line 101 is connected to one of the electrodes of the pixel capacitor Cp through the drain and source of the transistor TR. The gate of the transistor TR is connected to a scanning signal line 102, and the other electrode of the pixel capacitor Cp (common electrode) is connected to a common power source line (not shown).

The scanning signal lines 102 are connected to a scanning driver 104 which outputs a scanning signal. The data signal lines 101 are connected to a data driver 103 which samples an image signal and transfers it to the data signal lines 101 as a display data signal. The data driver 103 outputs a display data signal to the data scanning lines 101 for every scanning signal line 102 or for every pixel Z. The transistor TR is turned on when the scanning signal line 102 is activated, and then, the display data transferred on the data signal line 101 is written in the pixel capacitor Cp and the storage capacitor Cs.

A display at the pixel Z is maintained by the electric charge written in the pixel capacitors Cp and the storage capacitor Cs. An alternating current drive (inversion driving) is required to prevent the deterioration of the pixel capacitor Cp, or of the liquid crystal. When the alternating current drive is performed by a frame cycle, flickers of 30 Hz or 25 Hz are apparent though it may be different depending on the field frequencies (or frame frequencies) of the signals. Therefore, it is common to perform a inversion driving, a so-called "frame+1H line", in which the polarity of an electric charge supplied to the pixel capacitor is inverted by every horizontal scanning in addition to the frame inversion.

In the display apparatus requiring alternating current driving, such as a liquid crystal display apparatus, even if the contents (information) of a displayed image remain unchanged, a data driver needs to supply data signals to the data signal lines periodically for writing data in each of the pixels. This means a large amount of electric current is required for display.

This type of display apparatus has been increasingly used for the displays of hand-held information terminals in recent years. Since these hand-held information terminals are used outdoors and required to be driven with batteries or the like, it is preferable to lower their power consumption.

To solve this problem, liquid crystal display apparatuses capable of a binary display (two-tone display), which do not need to output data from a data driver periodically with the alternating current driving of the common electrode, have been proposed (Japanese Laid-Open Patent publication Nos. 58-143389 and 59-155893). These apparatuses includes data storage means and control means within each pixel. The data signal output on the data signal line from the data driver is input to the data storage means and the data is stored therein. States of the control means are controlled with the data, and the control means supplies the pixel electrode with a signal as long as the display data remains unchanged. Moreover, a display apparatus capable of imperfectly performing multi-tone display in a similar mechanism has been also proposed (Japanese Laid-Open Patent Publication No. 59-65879).

However, these proposed liquid crystal display apparatuses are essentially for the binary display (two-scale display). Although Japanese Laid-Open Patent Publication No. 59-65879 suggests a possibility for the multi-scale display, the circuit configuration of each pixel will become complicated and the power consumption can not be lowered sufficiently.

SUMMARY OF THE INVENTION

The active matrix type image display apparatus of this invention includes: a plurality of data signal lines; a plurality of scanning signal lines crossing the plurality of data signal lines; and a plurality of pixel portions disposed in a matrix in areas enclosed by the plurality of data signal lines and the plurality of scanning signal lines, wherein each of the plurality of pixel portions includes: a pixel capacitor for storing electric charge supplied from at least one of the plurality of data signal lines, to display an image; storage means connected to the pixel capacitor; and switching means which alternately selects one between an operation for electrically connecting the pixel capacitor to the storage means and an operation for electrically disconnecting the pixel capacitor from the storage means.

In one embodiment of the invention, the switching means electrically connects at least one of the data signal lines to the pixel capacitor at a predetermined period.

In another embodiment of the invention, the storage means has a first capacitor and a second capacitor.

In another embodiment of the invention, the switching means receives a first control signal and a second control signal from at least one of the plurality of scanning signal lines, the switching means electrically connecting the pixel capacitor to the first capacitor when the first control signal is received, and the switching means electrically connecting the pixel capacitor to the second capacitor when the second control signal is received.

In another embodiment of the invention, the switching means receives both the first control signal and the second control signal at least once in the predetermined period.

In another embodiment of the invention, the switching means receives a first control signal and a second control signal from at least one of the plurality of scanning signal lines, the switching means transferring electric charge having a positive polarity from the pixel capacitor to the storage means when the first control signal is received, and the switching means transferring electric charge having a negative polarity from the pixel capacitor to the storage means when the second control signal is received.

In another embodiment of the invention, the switching means receives both the first control signal and the second control signal at least once in the predetermined period.

In another embodiment of the invention, the pixel capacitor includes a liquid crystal capacitor having liquid crystal and a pair of electrodes disposed with the liquid crystal interposed therebetween, and a storage capacitor disposed in parallel with the liquid crystal capacitor.

According to another aspect of the invention, the active matrix type image display apparatus includes: a plurality of data signal lines; sampling circuits for supplying image signals to the plurality of data signal lines; a plurality of scanning signal lines crossing the plurality of data signal lines; and a plurality of pixel portions disposed in a matrix in areas enclosed by the plurality of data signal lines and the plurality of scanning signal lines, wherein each of the sampling circuits includes: a sampling capacitor for storing electric charge corresponding to the image signal; storage means for storing at least part of the electric charge stored in the sampling capacitor; and switching means which selects one between an operation for supplying at least part of the electric charge stored in the sampling capacitor to the storage means and an operation for supplying at least part of the electric charge stored in the storage means to the sampling capacitor.

In one embodiment of the invention, the storage means includes a first capacitor and a second capacitor.

In another embodiment of the invention, the switching means selects one between an operation for transferring electric charge having a positive polarity between the sampling capacitor and the first capacitor and an operation for transferring electric charge having a negative polarity between the sampling capacitor and the second capacitor.

According to another aspect of the invention, the active matrix type image display apparatus includes: a plurality of data signal lines; a plurality of scanning signal lines crossing the plurality of data signal lines; and a plurality of pixel portions disposed in a matrix in areas enclosed by the plurality of data signal lines and the plurality of scanning signal lines, wherein each of the plurality of pixel portions includes a pixel capacitor for storing electric charge supplied from at least one of the plurality of data signal lines, to display an image, and the image display apparatus includes switching means which can electrically connect the pixel capacitor of a first pixel portion of the plurality of pixel portions to the pixel capacitor of a second pixel portion adjacent to the first pixel portion.

In one embodiment of the invention, the image display apparatus further includes at least one control signal line, and the switching means electrically connects the pixel capacitor of the first pixel portion to the pixel capacitor of the second pixel portion, according to a control signal received from the control signal line.

In another embodiment of the invention, the pixel capacitor includes a liquid crystal capacitor having liquid crystal and a pair of electrodes disposed with the liquid crystal interposed therebetween, and a storage capacitor disposed in parallel with the liquid crystal capacitor.

According to the image displaying method of this invention, used in conjunction with an active matrix type image display apparatus including a plurality of data signal lines, and a plurality of pixel portions disposed in a matrix, each of the plurality of pixel portions having a pixel capacitor for storing electric charge to display an image, the method including: a first step of supplying electric charge corresponding to image data to a pixel capacitor of a first pixel portion of the plurality of pixel portions, via one of the plurality of data signal lines; a second step of supplying electric charge corresponding to image data to a pixel capacitor of a second pixel portion of the plurality of pixel portions, via one of the plurality of data signal lines; a third step of electrically connecting the pixel capacitor of the first pixel portion to the pixel capacitor of the second pixel portion.

In one method of the invention, the first step is a step of supplying electric charge having a first polarity to the pixel capacitor of the first pixel portion, and the second step is a step of supplying electric charge having a second polarity, which is different from the first polarity, to the pixel capacitor of the second pixel portion.

According to the present invention, display data (electric charge) supplied to the pixel capacitor for display is written and stored in the storage means by control means (switching means). The display data (electric charge) stored in the storage means may be read by the control means and used for display once again.

Display data (electric charge) provided to the sampling capacitor in the data driver may be written and stored in the storage means. The display data (electric charge) stored in the storage means may be read again into the sampling capacitor in the following frame and used for display.

By connecting a plurality of pixel electrodes to each other in a frame, a part of an electric charge used at a pixel can be used to perform display at another pixel.

According to the invention, since a part of or all of the data (electric charge) used for the previous display can be reused for the following display, the power consumption of an apparatus can be reduced effectively.

Thus, the invention described herein makes possible the advantages of providing an image display apparatus capable of sufficiently lowering the power consumption.

These and other advantages of the present invention will become apparent to those skilled in the art upon reading and understanding the following detailed description with reference to the accompanying figures.

BRIEF DESCRIPTION OF THE DRAWINGS

FIGS. 4A and 4B are examples of the driving signal wave patterns used in the circuits shown in FIGS. 3A and 3B.

FIGS. 8A and 8B are the driving signal wave patterns used in the circuits shown in FIGS. 7A and 7B, respectively.

DESCRIPTION OF THE PREFERRED EMBODIMENTS

The examples of the invention will be described referring to the accompanying drawings.

Figure 1:
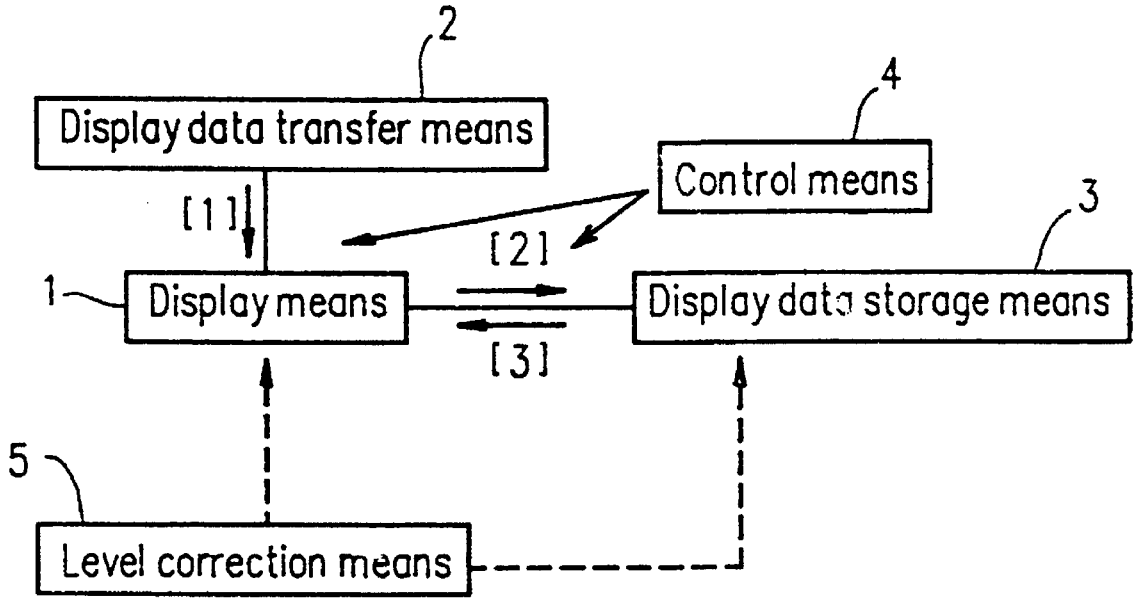
FIG. 1 is a block diagram schematically illustrating an image display apparatus according to the invention.

FIG. 1 is a block diagram which schematically illustrates an image display apparatus of the invention. The image display apparatus comprises display means 1 having a pixel for performing display, display data transfer means 2 for supplying a display data signal to the display means 1, display data signal storage means 3 for accumulating (storing) the data signal supplied to the display means 1, control means 4 for controlling the display data storage means 3, and providing the display means 1 with the data signal, and level correction means 5 for correcting the level of the data signal.

In the display apparatus of the invention, a display data signal output from the display data transfer means 2, such as a data driver, is transferred to the display means 1 ([1]). In the display apparatus, the information (data) accumulated in the display means 1 is refreshed during every predetermined period. For instance, in the case of a liquid crystal display apparatus, a pixel having liquid crystal is driven by an alternating current at a predetermined frequency. The information accumulated in the display means 1 is transferred to and accumulated in the display data storage means 3 based on a control signal from the control means 4 ([2]). Then, the data signal accumulated in the display data storage means 3 is again transferred to the display means 1 as necessary based on a control signal from the control means 4 and used for display ([3]). Therefore, the display data signal (electric charge) supplied from the display data transfer means 2 to the display means 1 in the pixel portion is reused. The level correction means 5 corrects the level of a data signal when the data signal fluctuates or such a fluctuation is expected in the above-described paths [2] and [3]. There are both writing means and reading means in each of the paths [2] and [3].

In a general display apparatus, the same information is often displayed successively in several fields in a certain short period of time. This tendency is especially common in the cases where the information processed by a computer or the like is displayed. The tendency is also found significant in any adjacent display lines (scanning signal lines) on a screen. Thus, in the above-described image display apparatus, the data signal accumulated in the display data storage means 3 can be transferred to the display means 1 as necessary, and is used for display. The low power consumption is thereby attained effectively.

Figure 2:
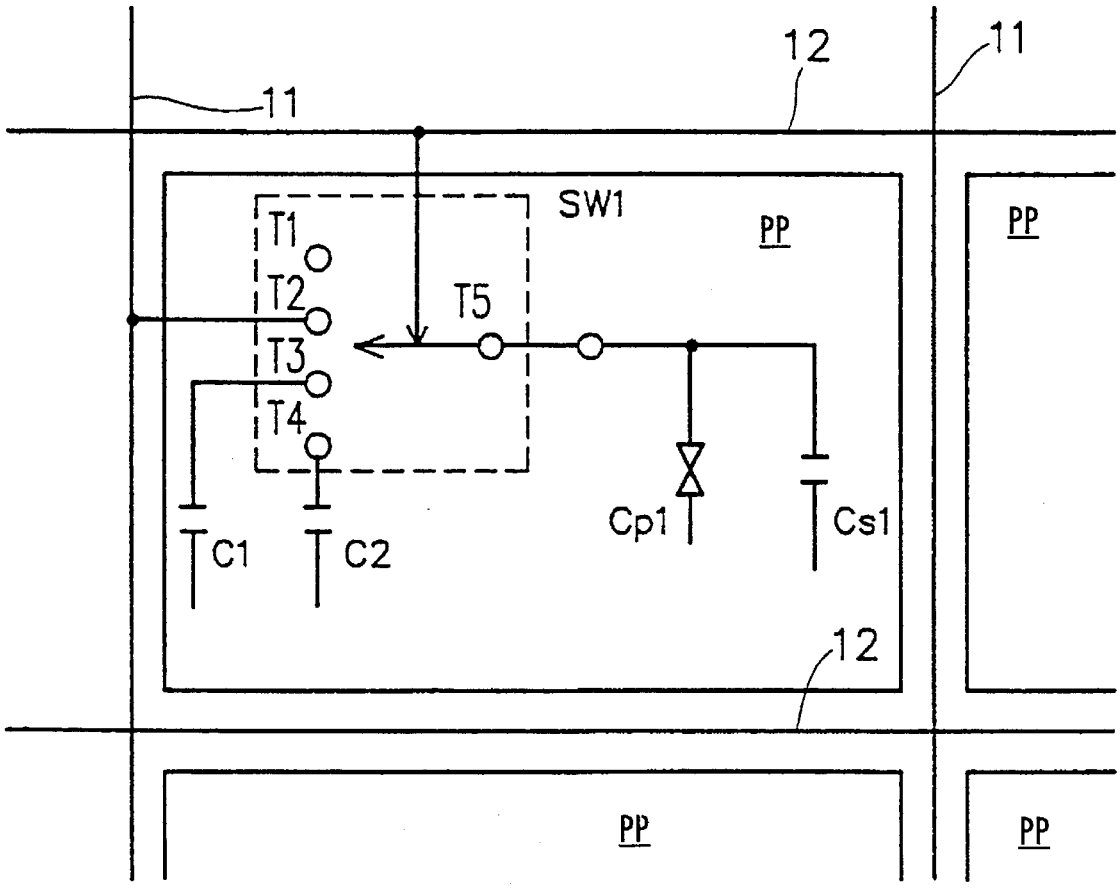
FIG. 2 is a view of an example of a liquid crystal display apparatus performing a frame inversion to which the invention is applied.

FIG. 2 shows an example where the invention is applied to an active matrix type liquid crystal display apparatus which displays information with a frame inversion. The liquid crystal display apparatus comprises a plurality of data signal lines 11, which are also called source bus lines, connected to a data driver, and a plurality of scanning signal lines 12 connected to a scanning driver and intersecting the data signal lines 11. Pixel portions are arranged in a matrix pattern at a plurality of regions surrounded by a plurality of data signal lines 11 and a plurality of scanning signal lines 12. Each of the pixel portions comprises a control switch SW1 having a switching element represented, for instance, by a transistor, a storage capacitor Cs1 connected to the control switch SW1, a liquid crystal capacitor Cp1 (as display means having a predetermined capacitance), a positive data holding capacitor C1, and a negative data holding capacitor C2. The liquid crystal capacitor Cp1 has a pair of electrodes for accumulating electric charge, and a liquid crystal material is interposed between the pair of electrodes. The storage capacitor Cs1 is connected in parallel to the liquid crystal capacitor Cp1 and used as an electric charge accumulation means for stabilizing displayed images. The control switch SW1 is connected to both of the signal lines 11 and 12, and used for both writing means and reading means (used for the control means). The storage capacitor Cs1 may be omitted.

The above-described control switch SW1 includes five terminals T1, T2, T3, T4, and T5. The terminal T1 is in an open state, the terminal T2 is connected to the data signal line 11, the terminal T3 is connected to the positive data holding capacitor C1 which holds a positive signal, the terminal T4 is connected to the negative data holding capacitor C2 which holds a negative signal, and the terminal T5 is connected to the storage capacitor Cs1 and the liquid crystal capacitor Cp1. The control switch SW1 is controlled so as to have any one of the following four states A, B, C, or D by a signal from the scanning signal line 12. The state of the terminal T5 being connected to the terminal T1 is denoted by a state A. The state where the terminal T5 is connected to a terminal T2 is denoted by a state B. The state where the terminal T5 is connected to the terminal T3 is denoted by a state C. The state where the terminal T5 is connected to the terminal T4 is denoted by a state D.

The operation of the liquid crystal apparatus having the above-described configuration will be described referring to examples. When the state of the control switch SW1 is at the state B, the terminal T2 is connected to the terminal T5 in the control switch SW1, and positive data on the data signal line 11 is written into a pixel capacitor having the storage capacitor Cs1 and the liquid crystal capacitor Cp1. In the display period following the writing period, the state of the control switch SW1 indicates the state A, the terminal T5 is connected to the terminal T1, and the data written in the pixel capacitor during the above-described writing period is displayed at the liquid crystal capacitor.

After the period of the display for the positive data signal, the control switch SW1 is set to the state C and at least a part of the data (electric charge) written in the pixel is transferred to the capacitor C1.

Then, the control switch SW1 is set to the state B to write a negative data signal transferred on the data signal line 11 into the pixel capacitor. After the writing period, the state of the control switch is set to A and the display period starts.

Next, after the display period for the negative data signal, the switch SW1 is set to the state D to transfer the data signal (electric charge) written in the pixel capacitor to the negative data holding capacitor C2.

When the positive data signal is displayed again, the control switch SW1 is set to the state C to write at least a part of the electric charge having been written in the capacitor C1 into the pixel capacitor. Thereby, the electric charge written in the pixel capacitor and the capacitor C1 are redistributed and each capacitor receives electric charge proportional to its capacitance ratio. As described above, since the display element performs an inversion drive and the electric charge written in the pixel capacitor and the electric charge written in the positive data holding capacitor C1 have opposite polarities from each other, the redistributed electric charge is smaller than the electric charge stored during the previous (two fields before) positive data display period. Thus, when the electric charges necessary for the display in the current field are not equal to the redistributed electric charge, the pixel capacitor needs additional electric charging. This addition of electric charging is performed by setting the control switch SW1 to the state B and writing positive data from the data signal line 11 into the pixel capacitor. Because the electric charge to be written is only an additional amount at this time, the power consumption is significantly reduced.

After the writing period, the control switch SW1 is set to the state A and the display period starts. The control switch SW1 is again set to the state C immediately before the ending of the display period to transfer the data (electric charge) having written in the pixel capacitor to the positive data holding capacitor C1.

After the display period, a negative data is written into the pixel capacitor in the same manner used for the above-described positive data. The control switch SW1 is set to the state D in the first place to write the electric charge written in the capacitor C2 into the pixel capacitor. Thereby, electric charge written in the pixel capacitor and electric charge written in the capacitor C2 are redistributed and each capacitor receives the electric charge proportional to its capacitance ratio. Since the electric charge written in the pixel capacitors and the electric charge written in the capacitor C2 have opposite polarities from each other, the redistributed electric charge is smaller than the electric charge stored during the previous (two fields before) negative field display period. Thus, when the electric charges necessary for the display in the current field are not equal to the redistributed electric charges, the pixel capacitor needs an additional charge. This addition of an electric charge is performed by setting the control switch SW1 to the state B to write negative data from the data signal line 11 to the pixel capacitor. Because the electric charge to be written is only an additional amount at this time, the power consumption is significantly reduced.

After the writing period, the control switch SW1 is set to the state A and the display period starts. The control switch SW1 is again set to the state D immediately before the ending of the display period to transfer the data (electric charge) written in the pixel capacitor to the negative data holding capacitor C2.

By repeating series of these operations, the electric charges to be charged and discharged at the pixel capacitor which are involved in the inverse driving of an image display apparatus can be reduced. The operation in which the terminal T2 is connected to the terminal T5 and the data signal line is thereby connected to the pixel capacitor is repeated by every field in a predetermined period. Note that the data holding times of the positive data holding capacitor C1 and the negative data holding capacitor C2 need to be equal to or longer than a period equivalent to the time for two fields (0.03–0.04 seconds) and it is not a problem for production. Moreover, by employing a certain method, such as refreshing the data accumulated in the data holding capacitors C1 and C2 periodically, the data holding times are not limited to the field period described above.

A buffer can be provided between the storage capacitor Cs1 or the liquid crystal capacitor Cp1 and the data holding capacitor C1 or C2.

A data correction circuit may be also provided to diminish a data fluctuation in the cases where a data fluctuation appears when the data is transferred between each of the capacitors, a leak of an electric charge occurs when the electric charge is held in the data holding capacitor or the pixel capacitor, or a leak of an electric charge occurs due to a switching element when the element is not conducting a current. Since this data correction circuit can equalize the data (electric charge) transferred from the data holding capacitor C1 or C2 into the pixel capacitor with the electric charge during the previous (two fields before) data display period, if the data of the current field is similar to or hardly different from the contents of the previous (two field before) data, the additional electric charge written in the data holding capacitor C1 or C2 need not be transferred to the pixel capacitor by setting the control switch to the state C or D.

Although the data holding capacitors C1 and C2 consist of capacitors, other data holding means, such as a memory or the like, can be used.

Only one scanning signal line 12 which controls the control switch SW1 is shown in the apparatus illustrated in FIG. 2. However, the scanning signal line 12 can consist of a plurality of lines and is not limited to only one line. More specific examples of the configurations will be described later. Each state of the control switch SW1 does not have to be a single state. For instance, the control states of the data transfer from the pixel capacitor to the data holding capacitor C1 or C2 and the data transfer from the data holding capacitor C1 or C2 to the pixel capacitor can be different. The transfer paths of these data transfers may be also different.

Both of the positive data holding capacitors C1 and the negative data holding capacitor C2 are not necessary and only one of them may be used. Resulting from this, the configuration of the control switch SW1 is also changed.

The data holding capacitors C1 and C2 can be used as the storage capacitor Cs1. Specifically, the storage capacitor Cs1 is omitted and the control switch SW1 is maintained at the state C during the positive data display period and at the state D during the negative data display period, thereby the data holding capacitors C1 and C2 can perform the same function as the storage capacitor does. Accordingly, the storage capacitor element in the pixel can be omitted so that the ratio covered by liquid crystal in the pixel is increased and the opening ration of an image display apparatus can be increased.

When data (electric charge) is transferred from the data holding capacitor to the pixel capacitor by switching the connecting of the two terminals of the data holding capacitor (one is connected to the pixel capacitor and the other is connected to a reference electrode, such as a common electrode) in the opposite way, the positive data holding capacitor C1 and the negative data holding capacitor C2 may be replaced with one capacitor. At this point, the data holding capacitor has the data signal corresponding to the image of one previous field which is strongly related to the data for the next image and the data can be reversed in its polarity and written into the pixel capacitor. In such a case, the data holding capacitors C1 and C2 can be formed separately from the storage capacitor Cs1, or the data holding capacitors can be used as the storage capacitor Cs1 as described above.

The above-described operation does not always need to be repeated between the display data storage means and the pixel capacitor (display means). Other means for stopping the operation can be provided as necessary, such as means for stopping the operation by an operator from outside of the apparatus or means that automatically stops the operation when the apparatus is turned on. These changes of designs described above will be applied similarly to the examples which will be described below.

The examples, in which the control switch, the configuration of the pixel portion, and the scanning signal line of the above-described example are changed variously will be described referring to FIGS. 3 to 8.

Figure 3A:
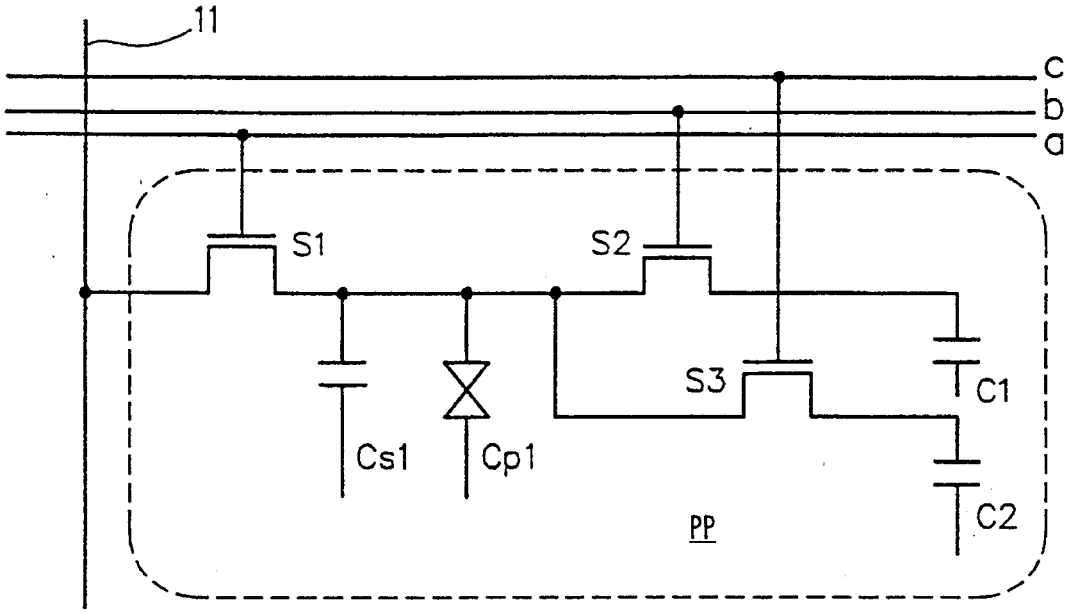
FIGS. 3A and 3B are circuit diagrams of the pixel portions in a case where the invention is applied to a configuration where a signal is provided to each pixel from a plurality of scanning signal lines.
Figure 3B:
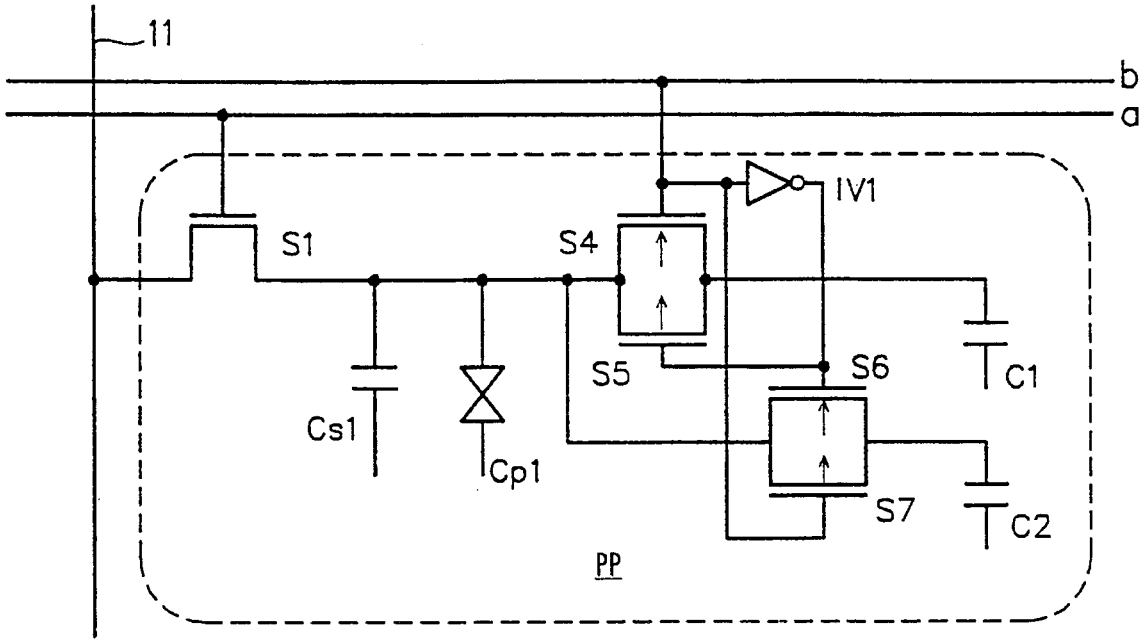

The examples in which a signal for controlling switching means is supplied from a plurality of scanning signal lines to each of pixels will be described. The circuit configurations of these examples are shown in FIGS. 3A and 3B. The examples of the driving signal waves (potentials of each scanning signal lines) and the potential of the liquid crystal capacitor Cp1 are shown in FIGS. 4A and 4B. FIGS. 4A and 4B show the driving signal waves when transistors S1, S2, S3, S4, S6, and S5, S7 in the FIGS. 3A and 3B are n-channel types and p-channel types, respectively.

The writing means and reading means having the transistors S2, S3, S4, S5, S6, and S7 are not limited to those shown in the figures and other configurations may be used. In such cases, the driving signal waves are also changed according to the respective configurations.

The example shown in FIG. 3A has three scanning signal lines a, b, and c. The transistor S1 is a switch controlled by a control signal applied from the scanning signal line a and writes data on a data signal line into a liquid crystal capacitor Cp1 and a storage capacitor Cs1. The transistor connects the data signal line to the pixel capacitor electrically when the control signal is applied. The transistors S2 and S3 are switches controlled by the scanning signal lines b and c, respectively. The transistors S2 and S3 transfer the data (electric charge) written in a pixel capacitor to the data holding capacitor (capacitor) C1 or C2, and/or transfer data in a data holding capacitor C1 or C2 to the pixel capacitor (Cs1 and Cp1) according to the polarity of the data. The transistor S2 electrically connects the pixel capacitor to the capacitor C1 when a first control signal is applied from the scanning signal line b. The transistor S3 electrically connects the pixel capacitor to the capacitor C2 when a second control signal is applied from the scanning signal line c.

As shown in FIG. 4A, the scanning signal lines b and c are driven with pulses provided immediately before the beginning of the respective data display periods and before the end of the respective data display periods, and the transistors S2 and S3 thereby become conductive. At this time, to avoid the electric charges from canceling each other by the short-cut between the data holding capacitors C1 and C2, it is preferable that the rising of the potential of one of the transistors S2 or S3 occurs after the falling of the potential of the other transistor. However, even if both of the rising and falling happen simultaneously, as far as the time of the short circuit is not very long, the effect is not negated.

FIG. 3B shows an example having two scanning signal lines a and b. In this example, a switching circuit provided between a pixel capacitor (Cs1 and Cp1) and both data holding capacitors C1 and C2, comprises transistors (switches) S4, S5, S6, S7 having a CMOS (Complementary Metal-Oxide Semiconductor) structure and an inverter IV1. The driving signal wave patterns on the scanning signal lines of this configuration are shown in FIG. 4B.

The operation of the example shown in FIG. 3B will be described below. By setting a control signal from the scanning signal line a at a "HIGH" state (referred to as the "H" state hereinafter), data on the data signal line is transferred to the pixel capacitor (Cs1, Cp1). By receiving the control signal having the "H" state from the scanning signal line b, the transistors S4 and S5 become conductive, As a result, data (electric charge) can be transferred between the pixel capacitor (Cs1, Cp1) and the data holding capacitor C1. By receiving the control signal (a second control signal) having a "LOW" state (referred to as the "L" state hereinafter) from the scanning signal line b, the transistors S6 and S7 become conductive. When the scanning signal line b is set at an "HZ" (high impedance) state (where the potential of the control signal is lower than the threshold voltage of an n-channel type transistor and higher than the threshold voltage of a p-channel transistor), all the transistors S4, S5, S6 and S7 are in a non-conductive state. When the input of the inverter IV1 is at the "HZ" state, its output is also at the "HZ" state.

In this example, the transistors S5 and S7 can be omitted. Or, the example may be also configured using only the transistors S5, S7 and the inverter IV1 without the transistors S4 and S6.

Figure 5:
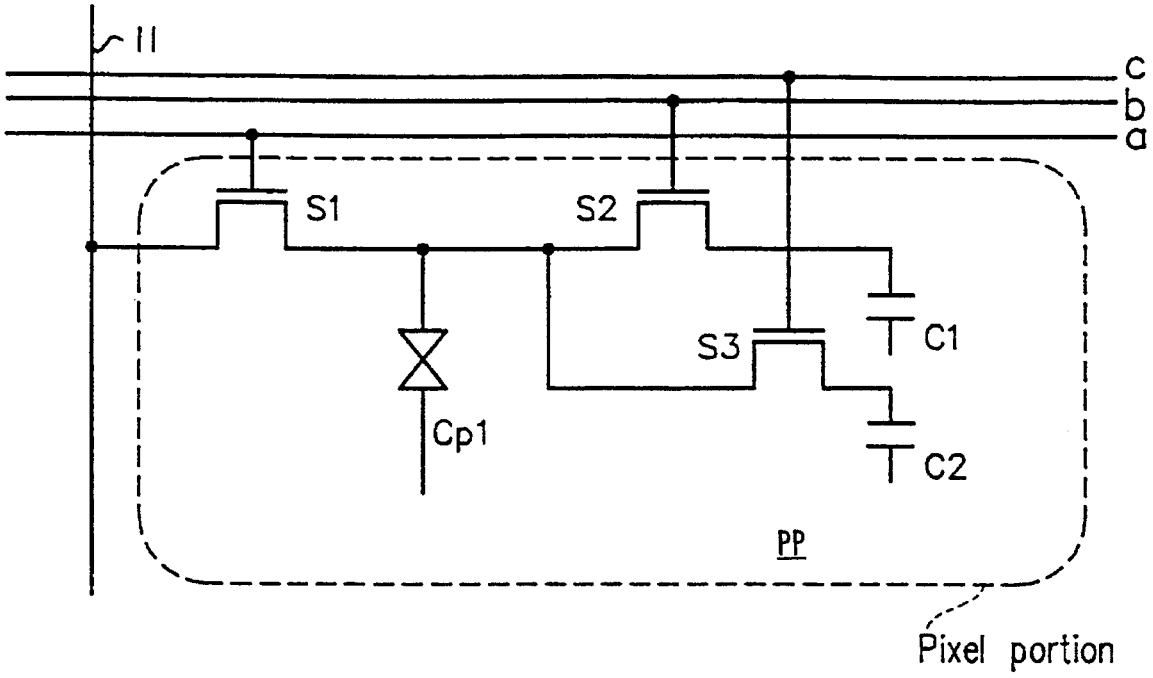
FIG. 5 is another circuit diagram of the pixel portions in a case the invention is applied to a configuration where a signal is provided to each pixel from a plurality of scanning signal lines.

FIG. 5 shows a pixel portion of an example wherein the control signals are provided from a plurality of scanning signal lines to each of the pixel portions and the data holding capacitor is also used as the storage capacitor for stabilizing images. In this example, all the transistors S1, S2, and S3 are n-channel types.

Figure 6:
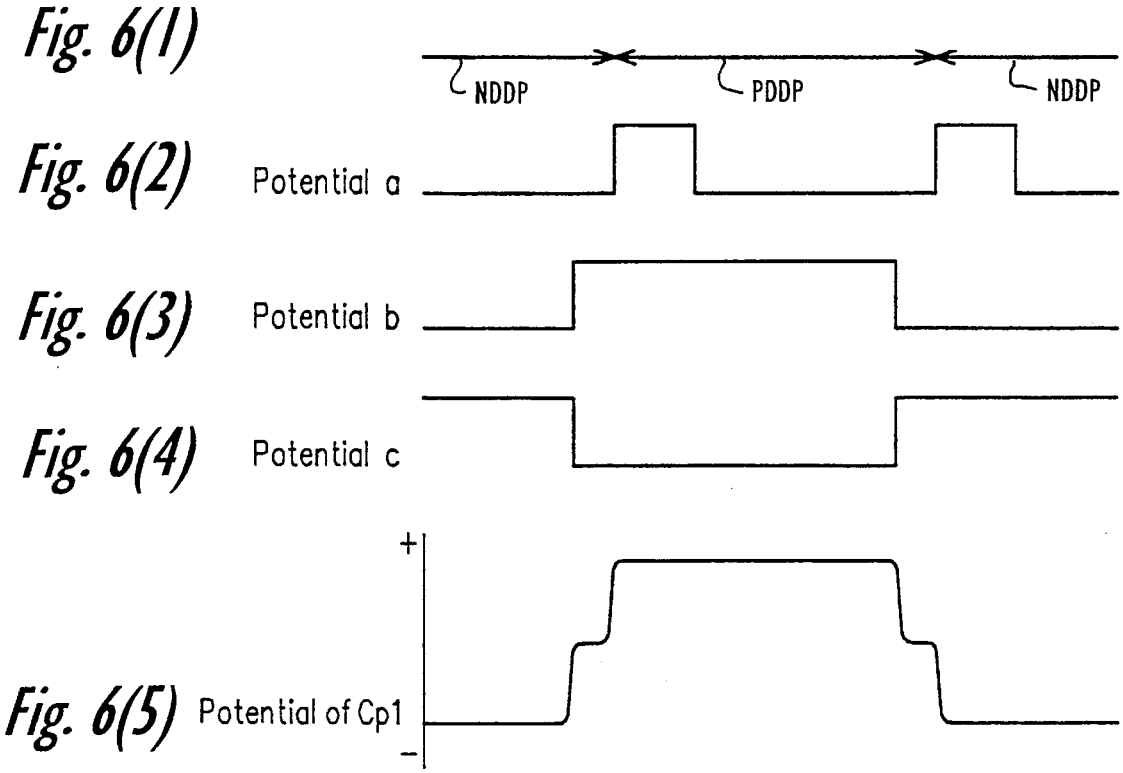
FIG. 6 is an example of a signal driving wave pattern used in the circuit shown in FIG. 5.

In the pixel portion shown in FIG. 5, the storage capacitor which was provided in parallel to the liquid crystal capacitor Cp1 is omitted, and the data holding capacitors C1 and C2 also function as storage capacitors. In this configuration, the liquid crystal capacitor Cp1 is connected in parallel to the data holding capacitor C1 or C2 for stabilizing images during the display period. The driving signal wave patterns (potentials) of the signal lines a, b, and c used in this example and the potential of the liquid crystal capacitor Cp1 are shown in FIG. 6.

Figure 7A:
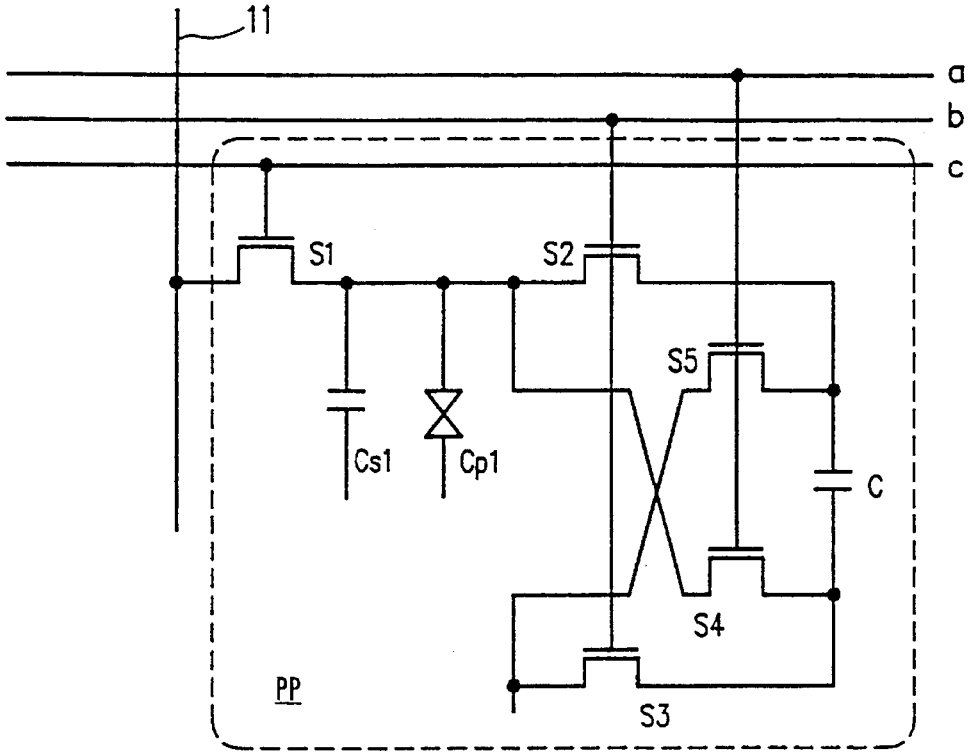
FIGS. 7A and 7B are other circuit diagrams of the pixel portions in a case the invention is applied to a configuration where a signal is provided to each pixel from a plurality of scanning signal lines.
Figure 7B:
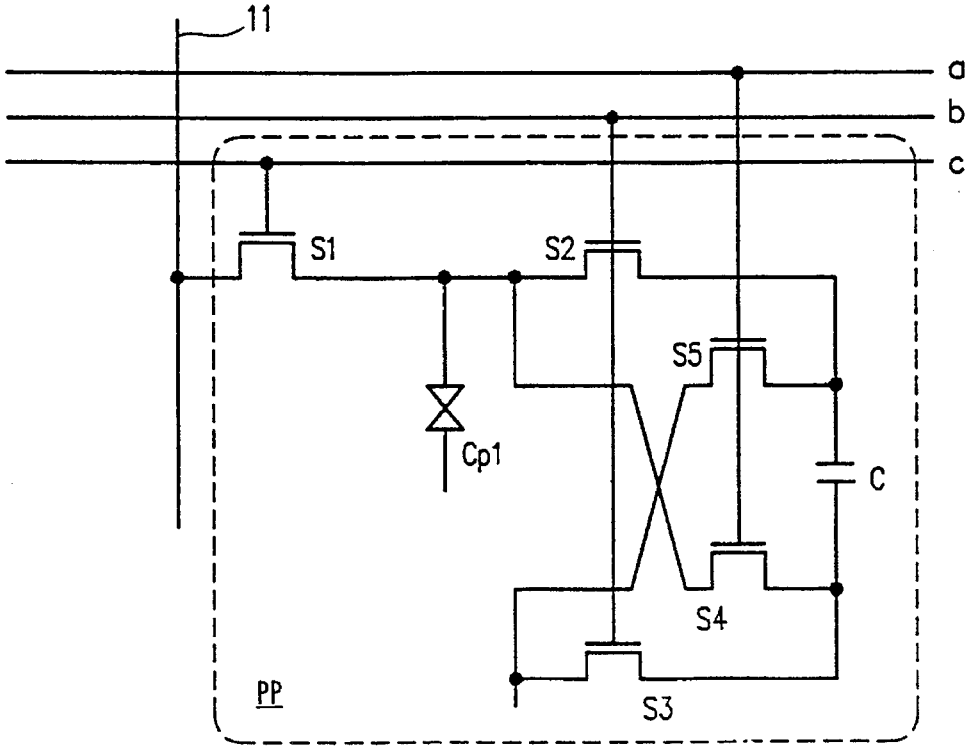

FIGS. 7A and 7B show examples where a control signal is supplied to each pixel from a plurality of scanning signal lines and a data holding capacitor C is switched in accordance with the polarities of the image signal. The driving signal wave patterns (potentials) of scanning signal lines used in each of the examples are shown in FIGS. 8A and 8B.

The transistors S1, S2, S3, S4 and S5 which are n-channel types are used in this example.

FIG. 7A shows an example in which a storage capacitor Cs1 is provided in parallel to a liquid crystal capacitor. In this example, the connection of the two terminals of a data holding capacitor are switched by a switching circuit provided between a data holding capacitor C and a pixel capacitor (Cs1, Cp1) in accordance with the polarities of images (data signals) to be displayed. In accordance with the scanning signal lines having the signal wave patterns shown in FIG. 8A, positive data accumulated in the data holding capacitor C is written into the pixel capacitors (Cs1 and Cp1) as negative data in the following field. With this configuration, the same effects attained in the example in FIG. 3A can be obtained with one data holding capacitor. Compared with the example shown in FIG. 3B, the number of the transistors, which are switching elements, increases by two and the number of the capacitors decreases by one. In a pixel portion, since the area occupied by one data holding capacitor is larger than the area occupied by two transistors, the effective display region can be increased.

Moreover, by combining the configuration of FIG. 5 with that of FIG. 7A, a configuration where a data holding capacitor is also used as a storage capacitor Cs1 can be realized as shown in FIG. 7B. The examples of the signal driving wave patterns of the scanning signal lines in this configuration are shown in FIG. 8B. In this example, there is only one capacitor in a pixel, and the region required for providing the data holding means can be very small.

In the examples described above, though the driving signals are supplied through the scanning signal lines b and c from outside of the pixel arrays formed into a matrix, the driving signals may be generated in each pixel by a signal applied to a single or a plurality of scanning signals a used for controlling the data transfer from the data signal line to the pixel capacitor (Cs1, Cp1).

This invention for lowering the power consumption of the pixel portions described above, can also be applied to lowering the power consumption of other portions, such as a sampling circuit or the like.

Figure 9:
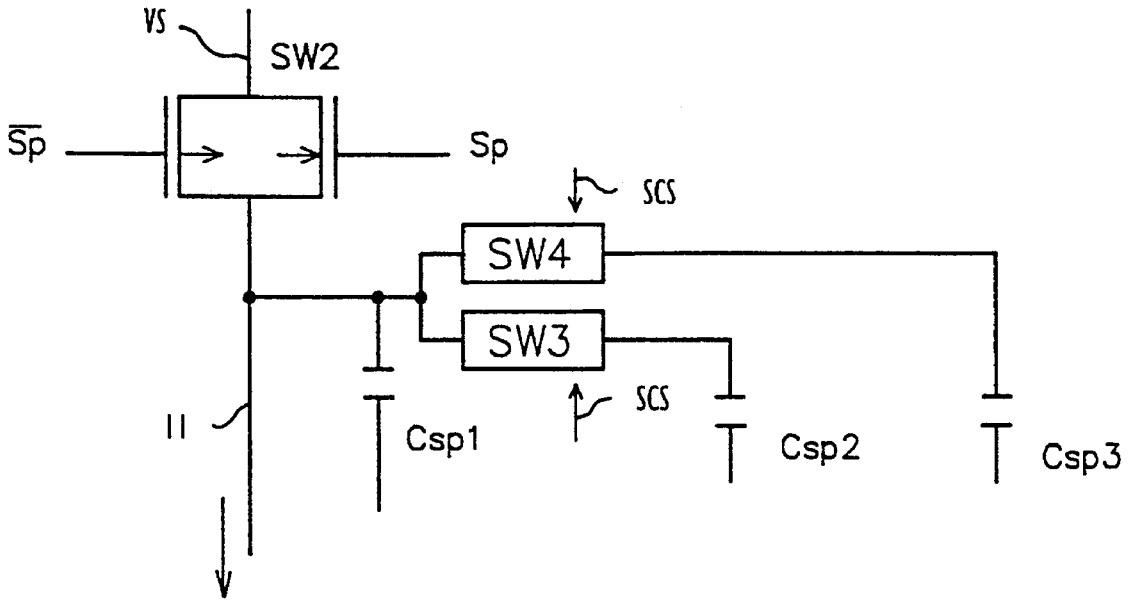
FIG. 9 is a diagram showing a case where the invention is applied to a sampling circuit of a liquid crystal display apparatus.

FIG. 9 shows a case where the invention is applied to a sampling circuit of a liquid crystal display apparatus. The sampling circuit is provided in a data driver of the display apparatus for each data signal line. The sampling circuit supplies an image signal such as a video signal to each data signal line. The sampling circuit includes a sampling switch SW2 into which a video signal is input. The sampling switch SW2 is controlled by sampling signals Sp and $\overline{Sp}$. The output of the sampling switch SW2 is connected to a sampling capacitor Csp1, and is further connected to a sampling storage capacitor Csp2 and a sampling storage capacitor Csp3 via a transfer switch SW3 and a transfer switch SW4, respectively. A positive signal is transferred into the sampling storage capacitor Csp2, and a negative signal is transferred into a sampling storage capacitor Csp3. In FIG. 9, the sampling switch SW2 is constructed by a transistor having a CMOS structure. Alternatively, the sampling switch SW2 can be constructed by either of an n-channel transistor or a p-channel transistor. Herein, the sampling storage capacitors correspond to the above-described data storage means, and the transfer switches correspond to the above-described writing means and reading means.

Next, the operation in the sampling circuit will be described. The operation in this case is basically similar to the operation for the pixel portion described above.

In the sampling period, the sampling switch SW2 is in a conductive state, so that the potential of the video signal (data) is written into the sampling capacitor Csp1. When the sampling period is terminated, the sampling switch SW2 becomes non-conductive. In the case of a line sequential scanning system which is called a "driver sample-hold system", for example, the sampled data is transferred to a succeeding transfer circuit after a predetermined time. In the case of a point sequential scanning system which is called a "panel sample-hold system", the sampled data is transferred to the data signal lines immediately after the sampling.

When the transfer period is terminated, in the apparatus of the invention, at least a part of the electric charges stored in the sampling capacitor Csp1 is transferred to the storage capacitor Csp2 or Csp3 depending on the polarity of the signal charged in the sampling capacitor Csp1. That is, when a positive signal is charged in the capacitor Csp1, the electric charge is transferred to the sampling storage capacitor Csp2 via the transfer switch SW3. When a negative signal is charged in the capacitor Csp1, the electric charge is transferred to the sampling storage capacitor Csp3 via the transfer switch SW4.

Next, the electric charges stored in the sampling storage capacitors Csp2 and Csp3 are transferred to the sampling capacitor Csp1 depending on the polarity of a video signal to be sampled, immediately before or after the video signal is sampled. In other words, when the signal to be sampled by the sampling capacitor Csp1 has a positive polarity, the electric charge stored in the sampling storage capacitor Csp2 is transferred to the sampling capacitor Csp1. When the signal to be sampled has a negative polarity, the electric charge stored in the sampling storage capacitor Csp3 is transferred to the sampling capacitor Csp1.

Figure 10A:
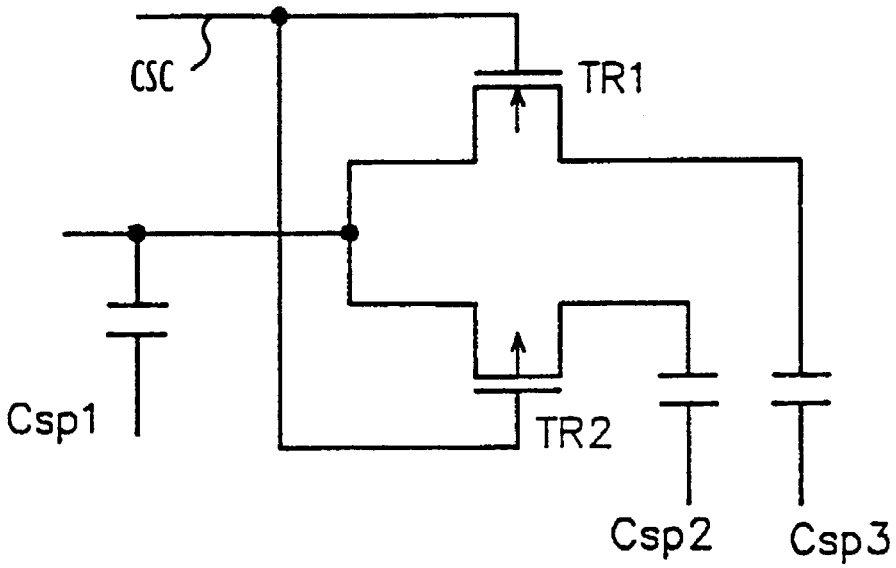
FIGS. 10A and 10B are diagrams showing exemplary constructions of a transfer switch of the sampling circuit shown in FIG. 9.
Figure 10B:
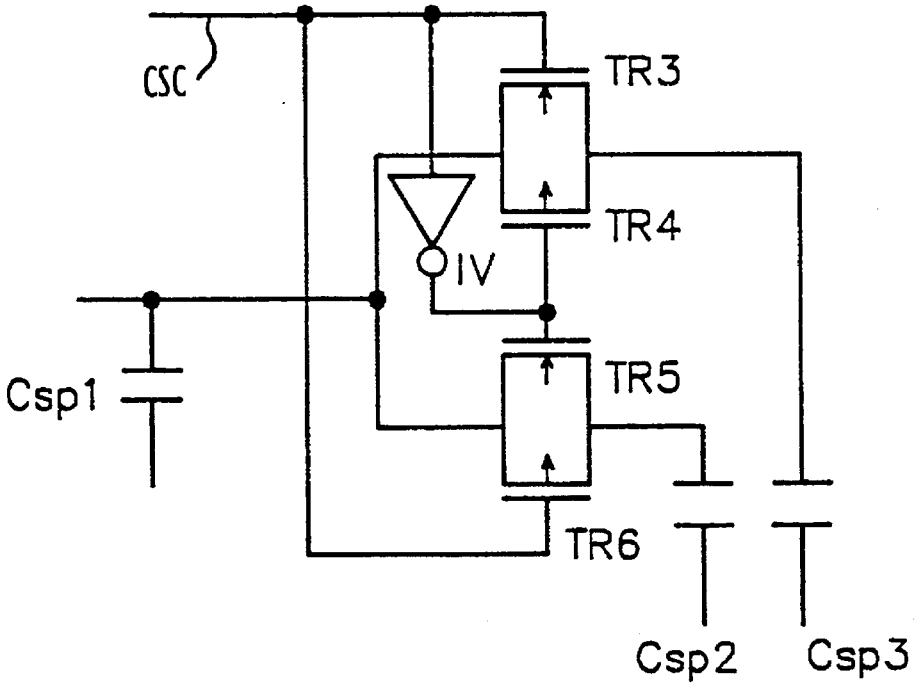

The transfer switches SW3 and SW4 may have such constructions as shown in FIGS. 10A and 10B. FIG. 10A shows the case where the transfer switches SW4 and SW3 are constructed with an n-channel transistor and a p-channel transistor, respectively. In this case, a transistor TR1 is equivalent to the transfer switch SW4, and a transistor TR2 is equivalent to the transfer switch SW3. FIG. 10B shows the case where the transfer switches SW3 and SW4 are constructed by CMOS switches. Transistors TR3 and TR4 are equivalent to the transfer switch SW4, and transistors TR5 and TR6 are equivalent to the transfer switch SW3. In these cases, a switch control signal for controlling the ON/OFF states of the transfer switches SW3 and SW4 can have one of three values, i.e., an H-state, an L-state, and a high-impedance HZ state. When the switch control signal is in the L-state, the transfer switch SW3 becomes conductive. When the switch control signal is in the H-state, the transfer switch SW4 becomes conductive. When the switch control signal is in the HZ-state, both of the transfer switches SW3 and SW4 become non-conductive (in an OFF state). In the case of FIG. 10B, an inverter IV is required to have such a construction that, when the switch control signal line is in the HZ-state, the output of the inverter also enters into the HZ-state.

In the circuits shown in FIGS. 10A and 10B, only one switch control signal line is provided. Alternatively, a plurality of switch control signal lines may be provided. In such a case, the construction of the transfer switches and the peripheral portion thereof should accordingly be changed.

The above method can be applied to cases where, when the sampling storage capacitors Csp2 and Csp3 are sufficiently larger than the sampling capacitor Csp1, the data (electric charge) used for a display is temporarily stored in data (electric charge) storage means such as a capacitor, and then used as data again, so as to lower the power consumption. When the sampling storage capacitors Csp2 and Csp3 are not sufficiently larger than the sampling capacitor Csp1, it is difficult to provide a display with good quality only using the data (electric charge) stored in the storage means. Thus, it is necessary to write additional data so as to provide a display with good quality. However, even in this case, there exists an effect in that the power consumption can be suppressed by an amount corresponding to the data (electric charge) read out from the storage means.

Figure 11:
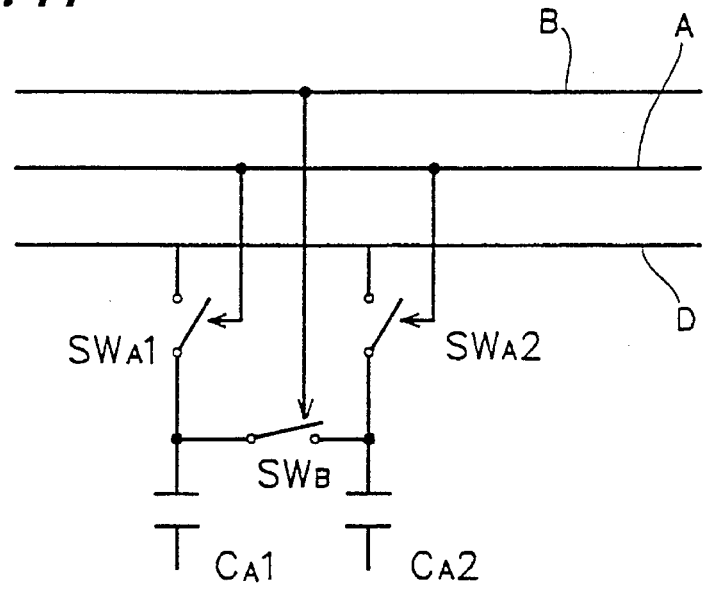
FIG. 11 is a diagram showing a basic concept of a liquid crystal display apparatus according to another example of the invention.

FIG. 11 is a diagram showing a basic concept of a liquid crystal display apparatus in another example of the invention. In the liquid crystal display apparatus, after a display, the data (electric charge) used for the display or the like is transferred to another portion in which the power consumption is also suppressed. The liquid crystal display apparatus includes a scanning signal line group A, a scanning signal line B, and a signal line D. To the signal line D, capacitors (load-capacitors) CA1 and CA2 are connected via switches SWA1 and SWA2, respectively. The switches SWA1 and SWA2 selectively connect and disconnect the signal line D to and from the respective capacitors. The states of the switches are controlled by the scanning signal line group A. A switch SWB (hereinafter referred to as a charge transfer switch) is provided in such a manner that one end thereof is connected between the switch SWA1 and the capacitor CA1, an the other end is connected between the switch SWA2 and the capacitor CA2. The charge transfer switch SWB transfers data (electric charge) between the capacitors CA1 and CA2. The state of the charge transfer switch SWB is controlled by the scanning signal line B. These switches can be constructed, for example, by switching elements such as transistors. For comparison, in the conventional apparatus, the switch SWB was not provided, and the data fed through the signal line D was controlled by the scanning signal line group A and the switches SWA1 and SWA2, and written into the capacitors CA1 and CA2.

The operation of the above-described liquid crystal display apparatus will be described. First, the switch SWA1 is made conductive (turned ON) by the scanning signal line group A, so that the data on the signal line D is written into the capacitor CA1.

Next, in the state where electric charge (data) written in the capacitor CA1 is not required or is scarcely required in view of the function associated with the capacitor CA1, the switch SWB is made conductive (turned ON), so that the data (electric charge) in the capacitor CA1 is transferred to the capacitor CA2.

Thereafter, or at the same timing if possible, the switch SWA2 is made conductive (turned ON), so that the data (electric charge) on the signal line D is written into the capacitor CA2. As a result, the movement of electric charge from the signal line D which may occur along with the writing of the data (electric charge) into the capacitor CA2 can be suppressed. Thus, the power consumption as a display apparatus can be lowered.

In FIG. 11, the capacitors CA1 and CA2 are connected to one and the same signal line D. Alternatively, the capacitors CA1 and CA2 may be connected to different signal lines, respectively. The scanning signal line group A for controlling the states of the switches SWA1 and SWA2 does not necessarily include a plurality of signal lines. There occurs no problem even when the scanning signal line group A includes only one signal line. In addition, the scanning signal line B is not necessarily a single line. There occurs no problem even when a plurality of scanning signal lines B are provided. Moreover, the scanning signal line group A and the scanning signal line B are not necessarily separately provided. One and the same scanning signal line can serve as the scanning signal line group A and the scanning signal line B.

In FIG. 11, the signal line D is used. Alternative to the signal line D, another line, for example a power supply line can be used. In such a case, as required, the capacitor may be substituted for another component such as a cell.

The transfer of data (electric charge) for lowering the power consumption is not necessarily performed only between the capacitors. Alternatively, the data transfer may be performed, for example, between a capacitor and a signal line. The direction of the data (electric charge) transfer is not limited to one direction. The data transfer may be performed bidirectionally, for example, from the capacitor CA1 to the capacitor CA2 and from the capacitor CA2 to the capacitor CA1.

The destination or the source of the charge transfer is not limited to one component. For example, the capacitor CA1 may be a capacitor group including a plurality of capacitors. In addition, the charge transfer is not necessarily performed by one stage as shown in FIG. 11. Alternatively, the charge transfer can be performed by multiple stages. The above-mentioned notices are also applied to respective examples described below.

In the liquid crystal display apparatus, an AC drive is usually performed so as to prevent the liquid crystal from deteriorating. For example, in the case of so-called "frame and line inversion drive" which is generally used for driving an active matrix type liquid crystal display apparatus, data is preferably transferred in such a way as shown in FIG. 12.

Specifically, if data of positive polarity is written into the m-th line in the n-th field, data of negative polarity is written into the (m+1)th line, data of positive polarity is written into the (m+2)th line, and data of negative polarity is written into the (m+3)th line. In the next field, i.e., in the (n+1)th field, the polarities of data written into respective lines are inverted from those in the n-th field. In the (n+1)th field, data of negative polarity is written into the m-th line, data of positive polarity is written into the (m+1)th line, data of negative polarity is written into the (m+2)th line, and data of positive polarity is written into the (m+3)th line.

Figure 12:
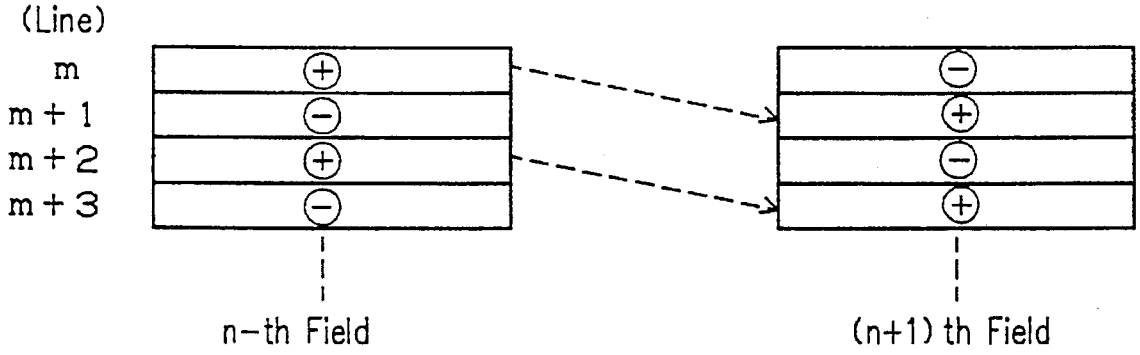
FIG. 12 is a diagram for illustrating a data transfer method in a frame and line inversion drive used in the example of the invention.

In order to perform the scanning in such a manner, for example as shown by arrows (broken lines) in FIG. 12, after the display of n-th field is finished and before the writing of the (n+1)th field, if the electric charge in the m-th line is transferred to the (m+1)th line, the electric charge in the (m+2)th line is transferred to the (m+3)th line, it is possible to lower the current consumption along with the writing of the (n+1)th field. That is, it is possible to realize an active matrix type display apparatus with low power consumption.

Figure 13:
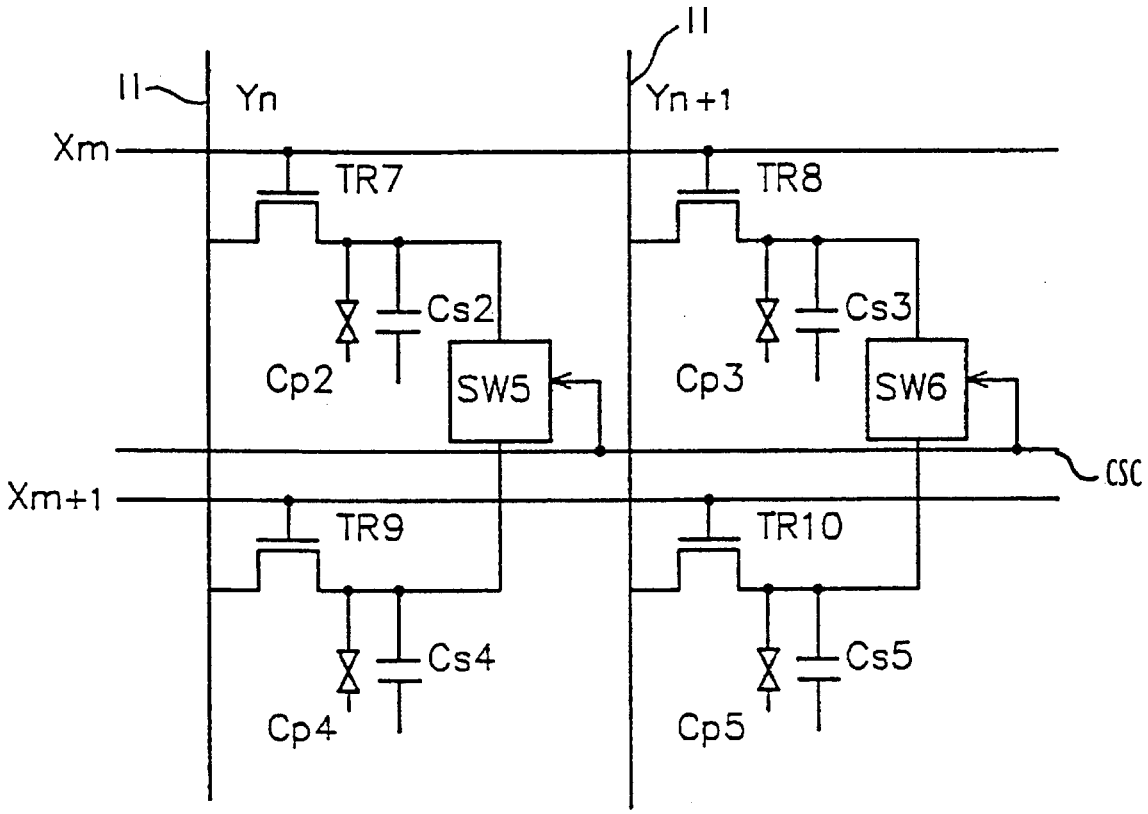
FIG. 13 is a circuit diagram showing another example of the invention.

FIG. 13 is a diagram showing another example of the invention. In FIG. 13, the reference letters Xm and Xm+1 denote scanning signal lines, and Yn and Yn+1 denote data signal lines. In the vicinity of the crossings of the scanning signal lines Xm and Xm+1 and the data signal lines Yn and Yn+1, transistors TR7, TR8, TR9, and TR10 are disposed. In each of the transistors TR7, TR8, TR9, and TR10, the gate electrode is connected to the scanning signal lines Xm and Xm+1, and one of the source and drain electrodes is connected to the data signal lines Yn and Yn+1. The other of the source and drain electrodes is connected to liquid crystal capacitors (capacitors having capacitances between pixel electrodes and counter electrodes, hereinafter referred to as LC capacitors) Cp2, Cp3, Cp4, and Cp5, and connected to storage capacitors Cs2, Cs3, Cs4, and Cs5 which are additionally used as required.

A charge transfer switch SW5 is connected between the other electrode of the transistor TR7 and the other electrode of the transistor TR9, and a charge transfer switch SW6 is connected between the other electrode of the transistor TR8 and the other electrode of the transistor TR10.

Figure 14:
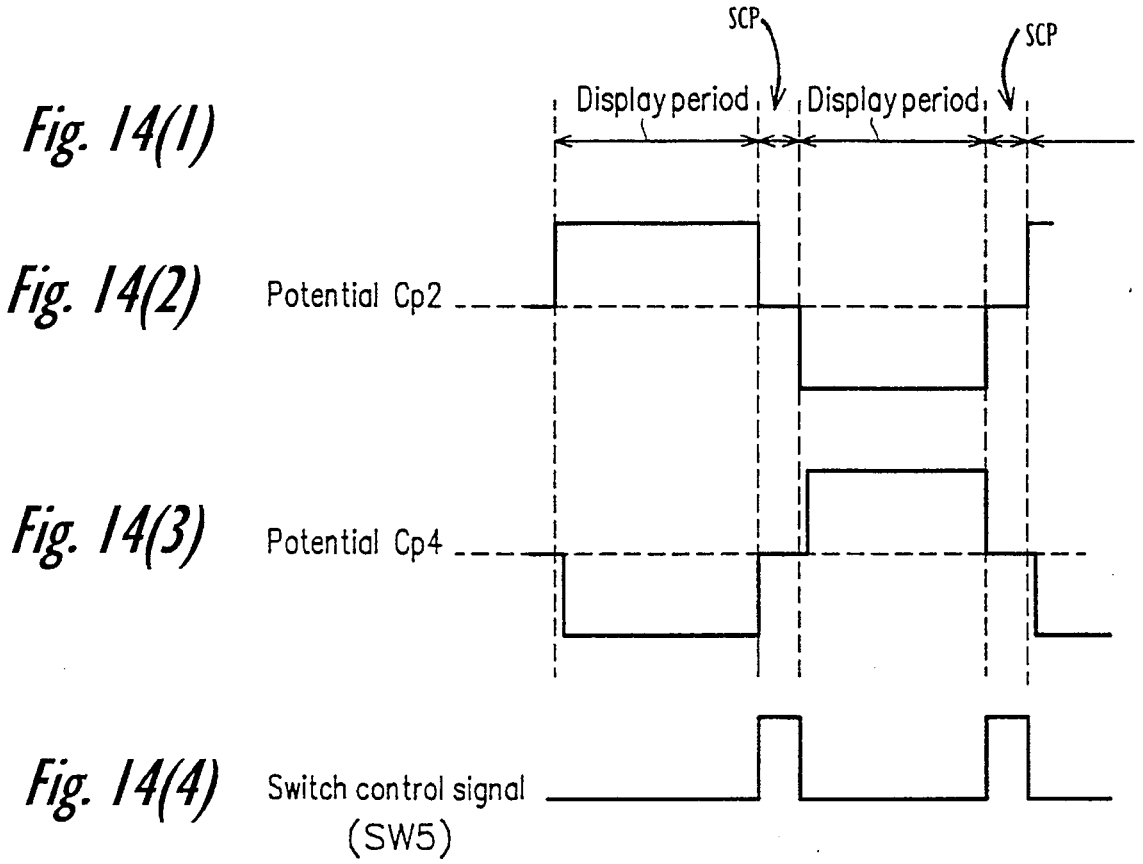
FIG. 14 shows exemplary driving waveforms used in the example shown in FIG. 13.

The switches SW5 and SW6 are switches for moving data (electric charges) between pixels. If the data (electric charge) is required to be transferred between pixels, the switches are made conductive (turned ON) by a switch control signal fed through a switch control signal line. For example, as is shown in FIG. 14, after the display of pixel having the LC capacitor Cp2 is finished, the switch control signal is made "H", so that the switch SW5 is made conductive (turned ON). Thus, the electric charge is transferred between the LC capacitor Cp2 and the LC capacitor Cp4. Then, the switch SW5 is made non-conductive (turned OFF), the writing into the LC capacitor Cp2 is performed, and successively the writing into the LC capacitor Cp4 is performed. In the case where the data signal lines for applying data signals to the LC capacitor Cp2 and the LC capacitor Cp4 are different from each other, the writing to the LC capacitor Cp2 and the writing to the LC capacitor Cp4 may be simultaneously performed.

Figure 15:
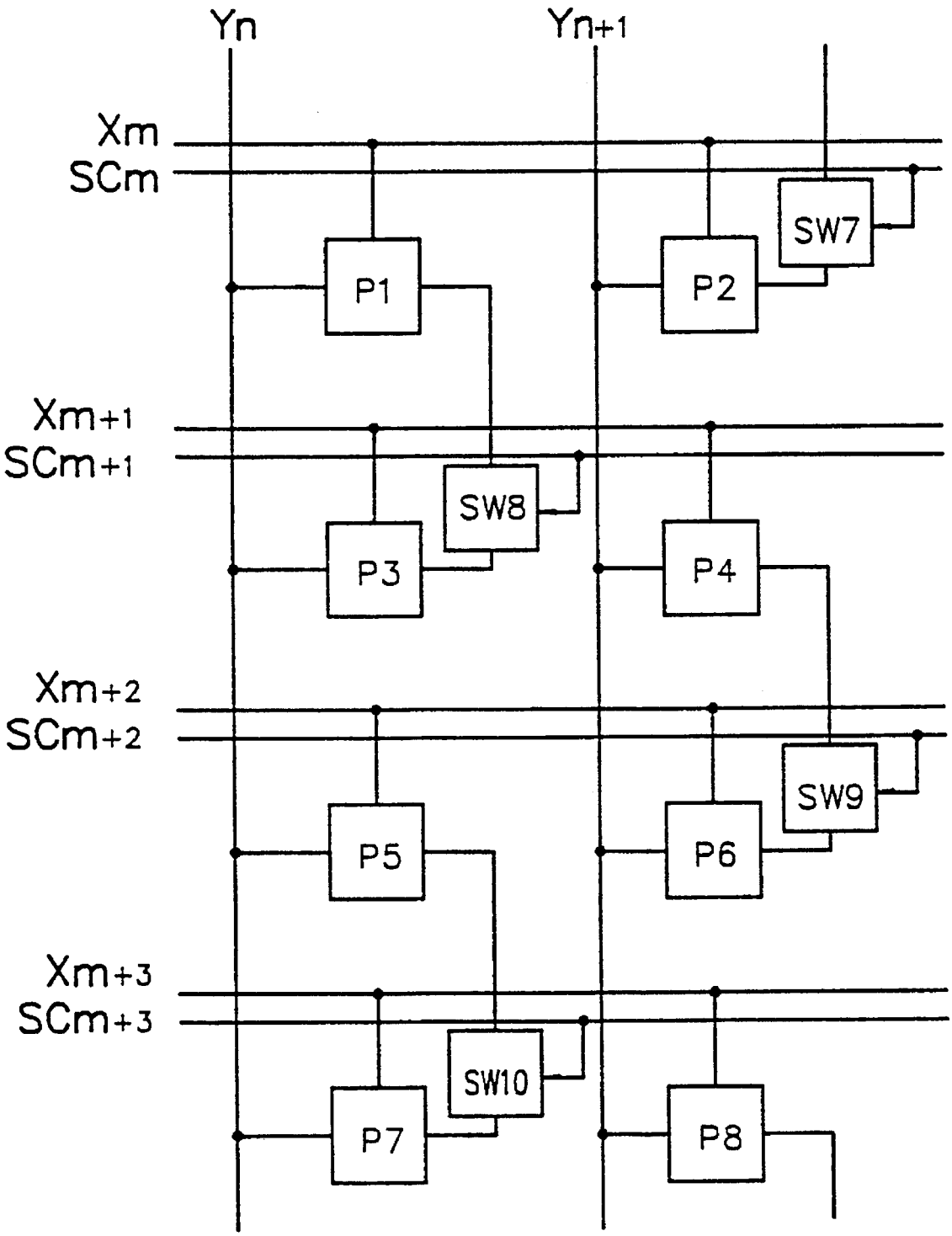
FIG. 15 shows a modification of the example shown in FIG. 13, and shows another exemplary connection of charge transfer switches.

In this example, as is shown in FIG. 13, all pairs of pixels adjacent to each other via the same scanning signal line Xm or Xm+1 are connected via the charge transfer switches SW5 and SW6 in a similar way. Alternatively, as is shown in FIG. 15, respective pairs of pixels adjacent to each other via different scanning signal lines Xm, Xm+1, Xm+2, and Xm+3 may be connected via charge transfer switches SW7, SW8, SW9, and SW10. In such a case, the charge transfer switches SW7, SW8, SW9, and SW10 are controlled by switch control signal lines SCm, SCm+1, SCm+2, and SCm+3, respectively. In FIG. 15, the reference letters P1, P2, etc. denote pixels each including a pixel driving element, a liquid crystal capacitor, and the like.

Figure 16:
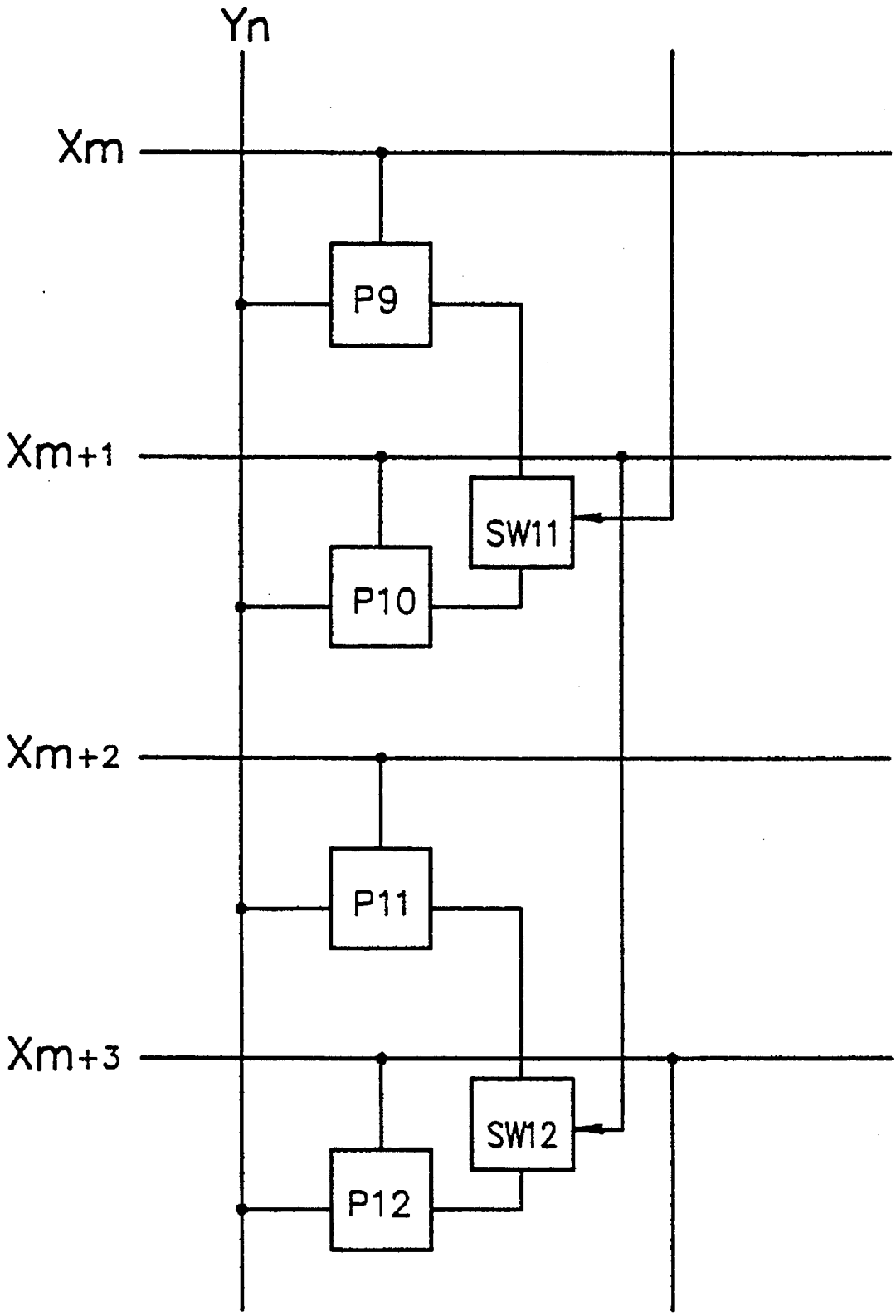
FIG. 16 shows a modification of the example shown in FIG. 13, and shows another exemplary connection of charge transfer switches.

Furthermore, as is shown in FIG. 16, another connection example can be adopted. In this example, the scanning signal lines Xm, Xm+1, Xm+2, and Xm+3 also function as switch control signal lines. That is, the scanning signal line Xm+1 transfers a signal to write the data into a pixel P10, a transfer switch SW12 thereby becomes conductive. The transfer switch SW12 is provided in such a manner that one terminal thereof is connected to a pixel P11 connected to the scanning signal line Xm+2 and the other terminal is connected to a pixel P12 connected to the scanning signal line Xm+3.

Figure 17A:
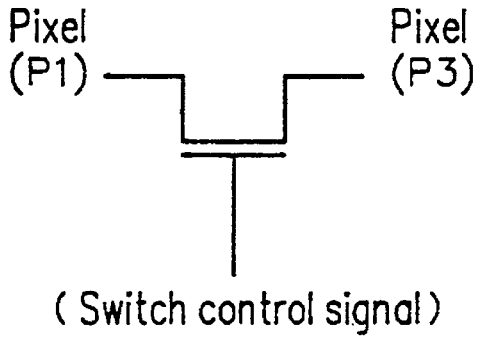
FIGS. 17A, 17B, and 17C show examples of a construction of a charge transfer switch.
Figure 17B:
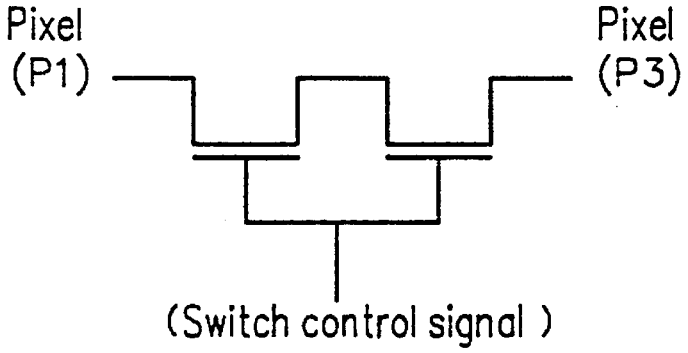
Figure 17C:
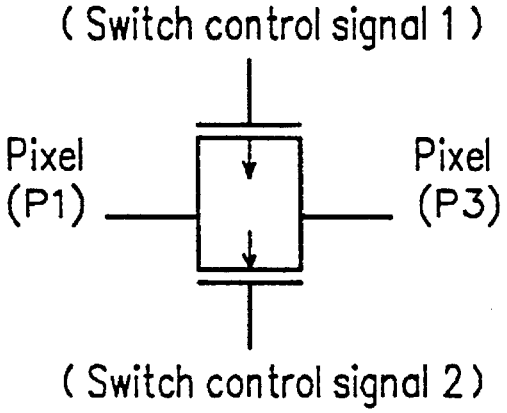

As examples of a construction of a charge transfer switch which performs data transfer between pixels, constructions shown in FIGS. 17A, 17B, and 17C can be adopted. FIG. 17A shows an example using a p-channel transistor or n-channel transistor controlled by a switch control signal. FIG. 17B shows an example in which such transistors are connected in series. FIG. 17C shows an example using a transistor having a CMOS structure controlled by a switch control signal 1 and a switch control signal 2.

As described above, in the constructions described with reference to FIGS. 13 to 17C, the charge transfer is performed for each pixel unit. Alternatively, the charge transfer may be performed by each scanning signal unit.

Figure 18:
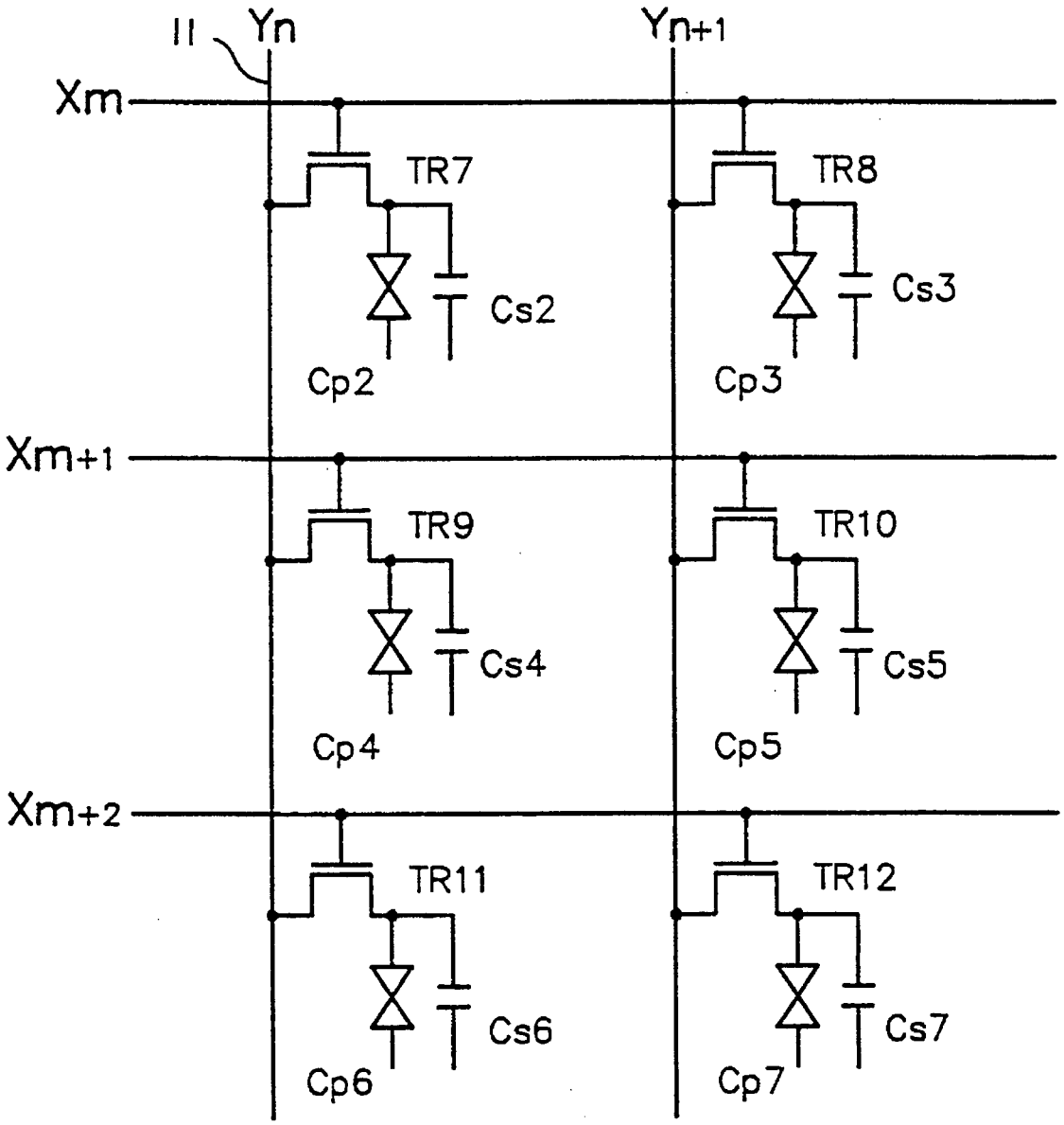
FIG. 18 is a diagram showing an example in which the charge transfer is performed by each scanning signal line unit according to the invention.
Figure 23:
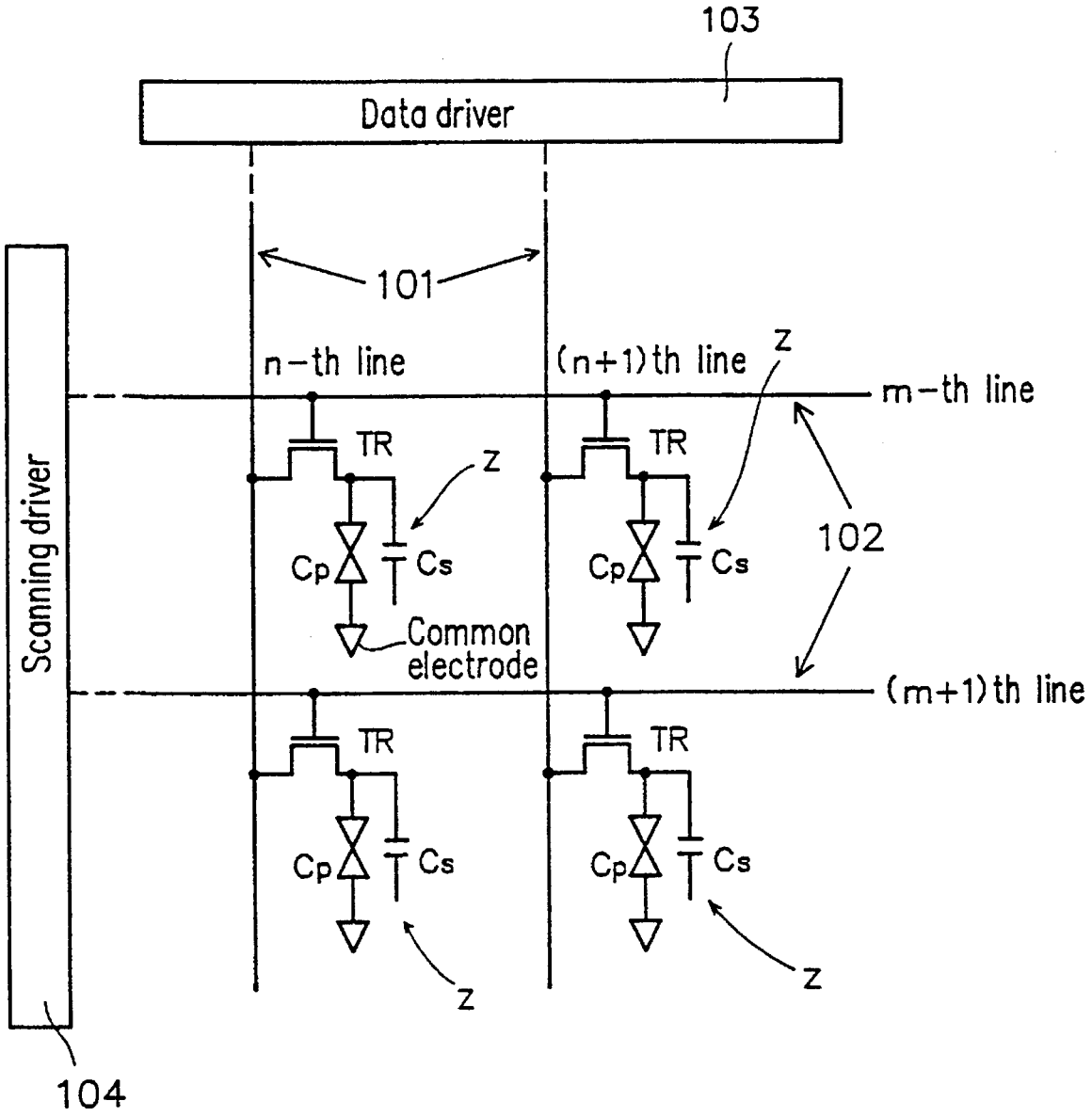
FIG. 23 is a diagram showing a circuit of a conventional liquid crystal display apparatus.

FIG. 18 is a diagram showing a construction in the case where the charge transfer is performed by each scanning signal line unit. In this case, a charge transfer switch SW is not provided between pixels. The construction itself is the same as the conventional construction shown in FIG. 23, but the operation of the scanning signal line is different from the conventional case.

Figure 19:
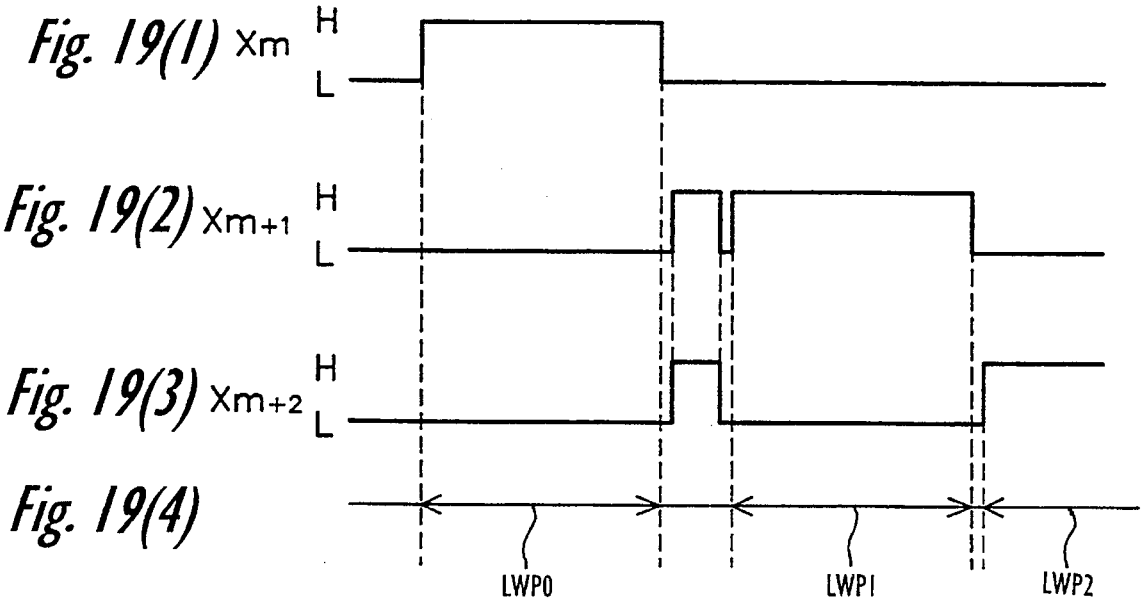
FIG. 19 shows exemplary driving waveforms of the scanning signal lines used in the example shown in FIG. 18.

FIG. 19 is a diagram for explaining an exemplary driving of the circuit shown in FIG. 18. In this case, the respective transistors TR7, TR8, TR9, TR10, TR11, and TR12 enter into the active state when respective gate signals fed through the scanning signal lines Xm, Xm+1, and Xm+2 are at the H level.

First, in the present field, image data is transferred to the pixel capacitor (storage capacitor Cs2 and the LC capacitor Cp2, and storage capacitor Cs3 and the LC capacitor Cp3) of the pixel portion connected to the scanning signal line Xm. In the meantime, electric charge (data signal) having a first polarity (positive) transferred during the previous field, has been stored in the pixel capacitor (storage capacitor Cs4 and the LC capacitor Cp4) of the pixel portion (first pixel portion) connected to the scanning signal line Xm+1. On the other hand, electric charge (data signal) having a second polarity (negative) transferred during the previous field, has been stored in the pixel capacitor (storage capacitor Cs6 and the LC capacitor Cp6) of the pixel portion (second pixel portion) connected to the scanning signal line Xm+2. The step in which the charge is transferred from the data signal line to the pixel capacitor (Cs4 and Cp4) of the first pixel portion, refers to a first step. The step in which the charge is transferred from the data signal line to the pixel capacitor (Cs6 and Cp6) of the second pixel portion, refers to a second step. The first polarity and the second polarity can be negative and positive, respectively.

Next, in the present field, the pixel capacitor of the first pixel portion is electrically connected to the pixel capacitor of the second pixel portion (refers to a third step). In the third step, the scanning signal lines Xm+1 and Xm+2 are set at the "H" state. As a result, the pixel capacitor (Cs4 and Cp4) of the first pixel portion and the pixel capacitor (Cs6 and Cp6) of the second pixel portion are electrically connected to each other, thereby electric charges move between them.

Thereafter, only the scanning signal line Xm+1 is set at the "H" state, and data is written into the pixel capacitor of the first pixel portion. In this stage, electric charge having the second polarity is stored in the pixel capacitor (Cs4 and Cp4) of the first pixel portion. Since charges having the second polarity have been moved to the first pixel portion from the second pixel portion in the third step, the amount of electric charges provided to the first pixel portion for displaying is reduced. As a result, the power consumption of the apparatus can be lowered.

The driving waveforms for the scanning signal lines are not limited to those shown in FIG. 19. Alternatively, the scanning signal lines are driven by signals having other waveforms. For example, the data writing period and the period for transferring data between pixels can be separately set as shown in FIG. 19. Alternatively, these periods are successively set as required.

Figure 20:
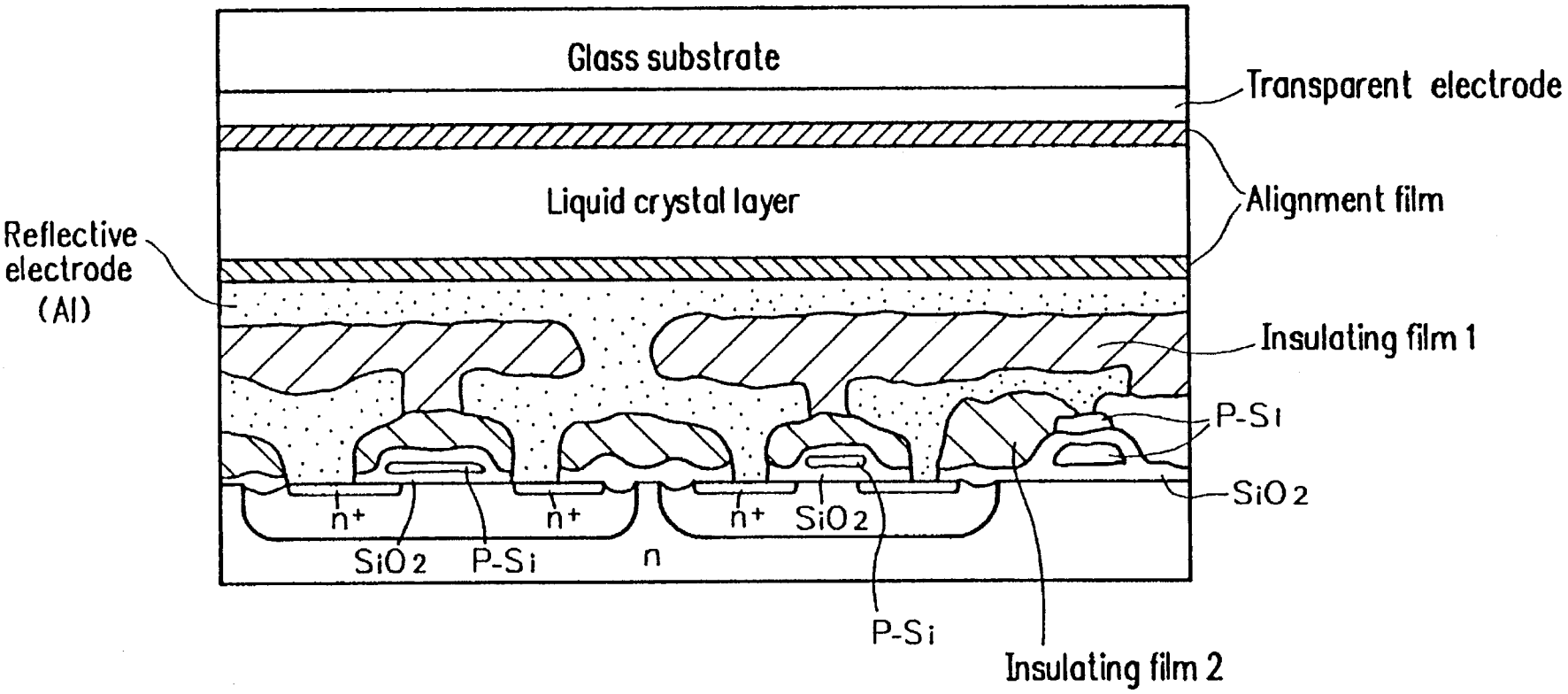
FIG. 20 is a cross-sectional view showing a reflection type display apparatus to which the present invention is applied.

The present invention can be applied to both a reflection type display apparatus and a transmission type display apparatus. When the present invention is applied to the reflection type display apparatus, as is shown in FIG. 20, it is possible to provide data storage means, a switching circuit, and the like over an entire region under a reflective electrode which is disposed on a side opposite to the display side with a liquid crystal layer as a display medium interposed therebetween. When the present invention is applied to the transmission type display apparatus, as shown in FIG.

21, it is necessary to provide data storage means, a switching circuit, and the like under a light shielding film indicated by hatching, so that the opening ratio may disadvantageously be reduced. For example, consider a display apparatus in which the width across corners is 5 inches and the number of pixels is 480 (V)×640 (H)×3 (RGB). An area of a portion constituting the data storage means, the switching circuit, or the like is required to be about 160 μm×about 53 μm in the reflection type, but an area allowed for the formation is large, so that there occurs no problem. On the contrary, in the transmission type, if it is assumed that the opening ratio is about 55%, an area of a portion constituting the data storage means, the switching circuit, or the like is about 4620 $\mu m^2$ (about 68μ×about 68 μm). Thus, the following special consideration is required for the formation of the apparatus.

As an example, a liquid crystal display apparatus is described. In the case where an amorphous silicon TFT (thin film transistor) is formed on a glass substrate which is now mainly used, the size of the TFT element is large, so that the space in which a switching circuit and the like is limited to some extent. On the other hand, in the case where a TFT is formed in a polycrystalline silicon film or a single crystal silicon substrate or the like, the device size can be reduced. This provides an excess space for the formation of the switching circuit and the like, and the circuit configuration under the pixels can be desirably selected.

Figure 21:
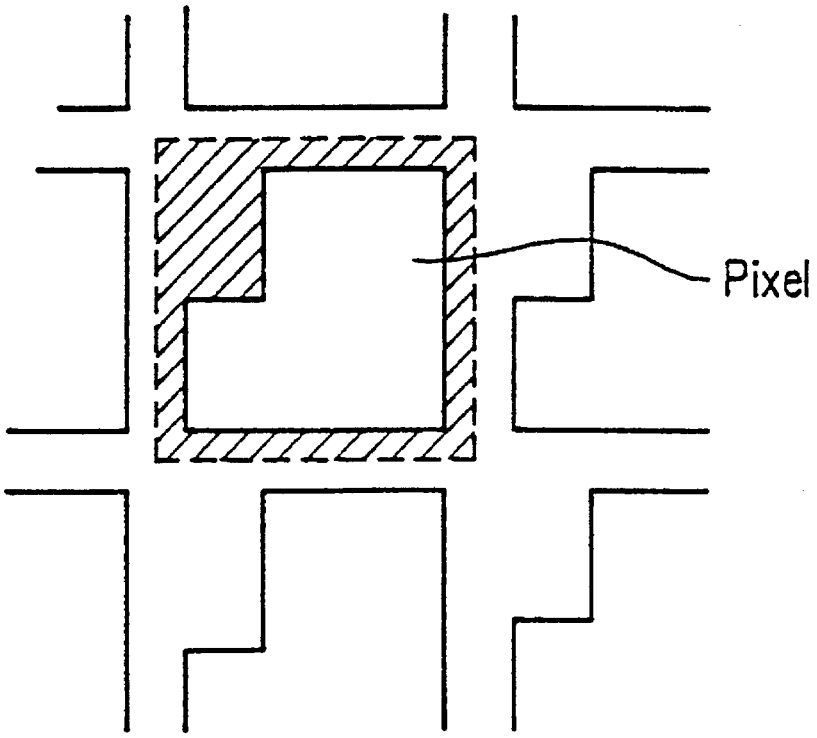
FIG. 21 is a cross-sectional view showing a transmission type display apparatus to which the present invention is applied.

FIGS. 20 and 21 each merely show one exemplary construction. The construction and the material can be varied. For example, in FIG. 20, the reflective electrode is made of Al. Alternatively, the reflective electrode may be made of Mo, Ta, or the like without causing any problems.

Figure 22:
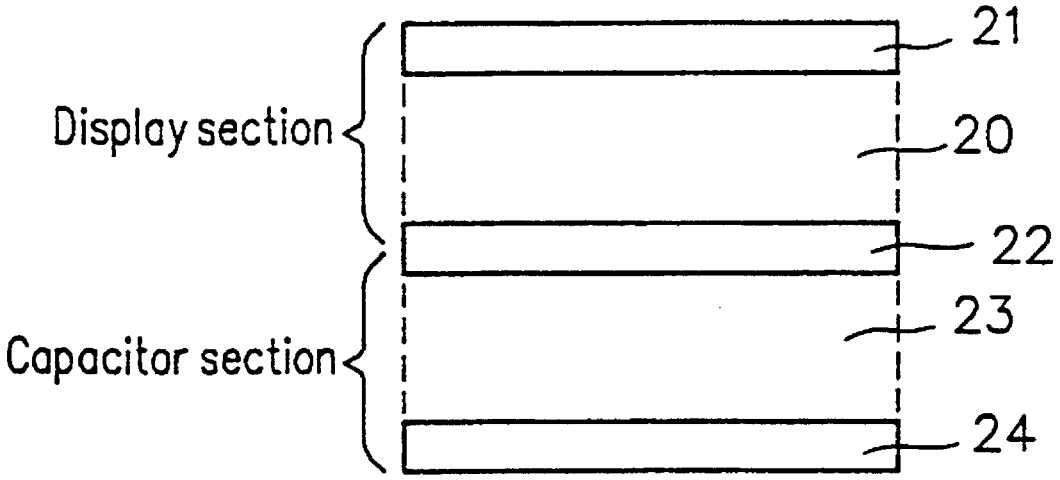
FIG. 22 is a cross-sectional view schematically showing the case where the invention is applied to a transmission type liquid crystal display apparatus.

In the case of the transmission type, if the capacitor is constituted as data storage means, and the capacitor is made of a transmission type dielectric, the pixel portion can be effectively utilized. FIG. 22 shows one example. Specifically, a liquid crystal layer 20 is provided between a pixel electrode 21 and a counter electrode 22, so as to constitute a display section. In addition, the counter electrode which functions as one of electrodes of the capacitor and an electrode which functions as the other electrode of the capacitor are disposed so as to face each other. A dielectric layer 23 is disposed therebetween, so as to constitute a capacitor section.

The configuration of the electrodes 21, 22, and 24 is not limited to the specific one shown in FIG. 22, but may be varied. For example, two counter electrodes 22 are provided. One electrode functions as an electrode of the capacitor, and the other functions as a counter electrode. Alternatively, the electrode which is adjacent to the electrode 24 for the capacitor may be the pixel electrode 21. In FIG. 22, other components such as a substrate are not shown. However, it is appreciated that such other components can be additionally provided as required.

Hereinabove, the method for reducing the power consumption has been described. However, only basic constructions are described in the above examples. It is appreciated that the above examples can be modified or combined as desired, without causing any problems.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An active matrix type image display apparatus comprising: a plurality of data signal lines; a plurality of scanning signal lines crossing the plurality of data signal lines; and a plurality of pixel portions disposed in a matrix in areas enclosed by the plurality of data signal lines and the plurality of scanning signal lines, wherein each of the plurality of pixel portions includes:

a pixel capacitor for storing electric charge supplied from at least one of the plurality of data signal lines to display an image;

a first capacitor and a second capacitor each for storing at least a portion of the electric charge; and switching means connecting between the pixel capacitor and one of the first capacitor, the second capacitor, and one of the plurality of data signal lines.

2. An image display apparatus according to claim 1, wherein the switching means receives a first control signal and a second control signal from at least one of the plurality of scanning signal lines, the switching means electrically connecting the pixel capacitor to the first capacitor when the first control signal is received, and the switching means electrically connecting the pixel capacitor to the second capacitor when the second control signal is received.

3. An image display apparatus according to claim 2, wherein the switching means electrically connects one of the plurality of data signal lines and the pixel capacitor in a predetermined period, the switching means receives both the first control signal and the second control signal at least once in the predetermined period.

4. An image display apparatus according to claim 2, wherein the switching means includes a first transistor, a second transistor and a third transistor, the first transistor being electrically connected to the one of the plurality of data signal lines, the pixel capacitor and the at least one of the plurality of scanning lines, the second transistor being electrically connected to the pixel capacitor, the at least one of the plurality of scanning lines, and the first capacitor, and the third transistor being electrically connected to the pixel capacitor, the at least one of the plurality of scanning lines, and the second capacitor.

5. An image display apparatus according to claim 2, wherein the switching means receives a third control signal and a fourth control signal from at least one of the plurality of scanning signal lines, the switching means transferring to the pixel capacitor when the third control signal is received the electric charge having a positive polarity and stored in at least one of the first capacitor and the second capacitor, and the switching means transferring to the pixel capacitor when the fourth signal is received the electric charge having a negative polarity and stored in at least one of the first capacitor and the second capacitor.

6. An image display apparatus according to claim 1, wherein the pixel capacitor includes a liquid crystal capacitor having liquid crystal and a pair of electrodes disposed with the liquid crystal interposed therebetween, and a storage capacitor disposed in parallel with the liquid crystal capacitor.

7. An image display apparatus comprising: a plurality of data signal lines; a plurality of scanning signal lines crossing the plurality of data signal lines; and a plurality of pixel portions disposed in a matrix in areas enclosed by the plurality of data signal lines and the plurality of scanning signal lines, wherein each of the plurality of pixel portions includes:

a pixel capacitor for storing electric charge supplied from at least one of the plurality of data signal lines to display an image;

storage means for storing at least a portion of the electric charge; and switching means connecting between the pixel capacitor and the storage means or between the pixel capacitor and one of the plurality of data signal lines, wherein the switching means receives a first control signal and a second control signal from at least one of the plurality of scanning signals lines, the switching means transferring electric charge having a positive polarity from the pixel capacitor to the storage means when the first control signal is received, and the switching means transferring electric charge having a negative polarity from the pixel capacitor to the storage means when the second control signal is received.

8. An image display apparatus according to claim 7, wherein the switching means electrically connects one of the plurality of data signal lines and the pixel capacitor in a predetermined period, the switching means receives both the first control signal and the second control signal at least once in the predetermined period.

* * * * *